US007320401B1

(12) United States Patent
Chandler

(10) Patent No.: US 7,320,401 B1
(45) Date of Patent: Jan. 22, 2008

(54) MY PUTTER PAL PUTTER HOLDER

(76) Inventor: Edward H. Chandler, 453 Dolphin St., Melbourne Beach, FL (US) 32951

( * ) Notice: Subject to any disclaimer, the term of this patent is extended or adjusted under 35 U.S.C. 154(b) by 711 days.

(21) Appl. No.: 10/785,159

(22) Filed: Feb. 23, 2004

(51) Int. Cl.
*A63B 55/00* (2006.01)

(52) U.S. Cl. ..... 206/315.2; 206/315.3

(58) Field of Classification Search ..... 206/315.2, 206/315.3, 315.5
See application file for complete search history.

(56) References Cited

U.S. PATENT DOCUMENTS

| | | | | | |
|---|---|---|---|---|---|
| 2,595,987 | A | | 5/1952 | Shears | |
| 3,985,229 | A | | 10/1976 | Maki | |
| 4,100,652 | A | | 7/1978 | Carlson | |
| 4,194,547 | A | * | 3/1980 | Sidor et al. | 206/315.6 |
| 4,350,194 | A | | 9/1982 | Brown | |
| 4,509,643 | A | * | 4/1985 | Rhee | 206/315.8 |
| 4,838,416 | A | | 6/1989 | Carman | |
| 4,869,365 | A | * | 9/1989 | Perdue et al. | 206/315.5 |
| 4,932,523 | A | | 6/1990 | Yamazoe | |
| 5,088,600 | A | | 2/1992 | Kopp | |
| 5,332,090 | A | | 7/1994 | Tucker | |
| D352,392 | S | * | 11/1994 | Little | D3/255 |
| 5,472,084 | A | * | 12/1995 | Aliano, Jr. | 206/315.3 |
| 5,566,870 | A | * | 10/1996 | Mejeur | 224/218 |
| 5,755,322 | A | | 5/1998 | Yang | |
| 5,816,396 | A | * | 10/1998 | Shin | 206/315.3 |
| 6,126,050 | A | * | 10/2000 | Aliano, Jr. | 224/274 |
| 6,161,691 | A | | 12/2000 | Ratcliff et al. | |
| 6,244,437 | B1 | * | 6/2001 | Rogers | 206/315.2 |
| 6,375,004 | B1 | | 4/2002 | Tuerschmann | |
| 6,571,947 | B1 | * | 6/2003 | Rogers | 206/315.2 |
| 7,059,470 | B2 | * | 6/2006 | Slankster | 206/315.3 |

* cited by examiner

*Primary Examiner*—Tri M. Mai

(57) ABSTRACT

In a golf club carrying system, a simple, attractive, sleeve-like, removable device for attaching to the exterior surface of a golf bag, for holding a golf club or other implement. The device is securely and removably attached externally to a golf bag. The device holds, isolates and protects an inverted golf club or other implement during a round in the game of golf, and the golf club or other implement is readily and conveniently accessible by a golfer.

1 Claim, 23 Drawing Sheets

MY PUTTER PAL PUTTER HOLDER

FEDERALLY SPONSORED RESEARCH PROGRAM

Not Applicable

SEQUENCE LISTING OR PROGRAM

Not Applicable

BACKGROUND

1. Field of Invention

This invention relates to golf bags. Specifically, to a novel, unique, improved device for holding a putter or other implement used during a round in the game of golf.

2. Discussion of Prior Art

Golfers have routinely carried their golf clubs inside a golf bag while playing a round of golf. The Rules of Golf allow as many as fourteen clubs to be carried in a golf bag. Each club is subject to damage by contact with other clubs in the bag. A putter that resides inside a golf bag, along with thirteen or so other golf clubs must be located, accessed and removed by a golfer when preparing to putt. After puffing, the golfer reverses this process and returns the putter to the golf bag alongside the other golf clubs. The golfer must locate, retrieve and replace the putter as many as eighteen times in one round of golf. These activities are repetitive and time consuming.

For years, inventors have found ways and means to make it easier and quicker for a golfer to access a particular club. At times, singling out the puffer. Inventors have also found ways and means to provide better protection for the puffer and other golf clubs. Several types of putter holders have been invented. Some for holding an upright putter and others for holding an inverted putter. Some for use on the inside of a golf bag and others for use on the outside of a golf bag. Some inventions protect the putter handle and shaft and others the putter head. Some provide no protection for a putter. For example, U.S. Pat. No. 5,332,090 to Tucker, Golf Putter Holder (1994), shows a removable device attached to the outside of a golf bag for holding an upright putter. The Abstract states, "In this way, when the putter shaft is inserted into the holder, it cannot be removed until the putter is again lifted from the holder". When an upright putter is carried in this particular holder, the putter handle, shaft and head are exposed and subject to damage. On one occasion a mallet head putter of a member of my foursome, was in this holder on a golf bag carried in a moving golf car when it was bounced, jostled or ejected from the holder and fell to the ground.

PRIOR ART PATENTS (a) The two devices of U.S. Pat. No. 4,100,652 to Carlson, Golf Club Anchor (1978) and U.S. Pat. No. 2,595,987 to Shears, Golf Club Holder (1952). Each of these patents discloses a removable golf club holder for inverted clubs to be used inside a golf bag. All golf clubs, putter included, are carried inside the golf bag. A putter carried in either of these devices is subject to contact with other clubs inside the golf bag. There is no provision for preventing contact between the putter head and other clubs and therefore they are subject to damage.

(b) The device of U.S. Pat. No. 5,816,396 to Shin, Putter Case and Method (1997). This patent discloses a complex putter holder, removably attached to the exterior of a golf bag for holding an inverted putter. This is a complex device and can be expensive to manufacture. The head of a putter inserted into this putter holder will be subject to contact with clubs inside the golf bag. The holder design is such that the head of a putter inserted into the holder will rest upon, or be above, the topmost part of the holder which is above the rim of the golf bag. This invites contact between the putter head, which is above the rim of the golf bag, and other clubs inside the golf bag. Such contact can cause nicks, scrapes or other damage to the putter head and/or golf clubs carried inside the golf bag.

(c) The device of U.S. Pat. No. 6,244,437 B1 to Rogers, Universal Golf Bag Putter Holder (2001). This patent discloses a putter holder attached to the inside of a golf bag for holding an inverted putter. FIG. 1 of U.S. Pat. No. 6,244,437 shows a putter 13 with part of the putter head extending inside the golf bag. The exposed part of the putter head is not protected by the "cushioning member". This invites contact between a portion of the putter head and other clubs carried inside the bag. In addition, the Abstract states, "The object of this invention is to provide a golf bag putter holder that is convenient to use and protects, stores, aligns and segregates the putter and additionally is universal in its application". In practice, this broad objective of universality may be difficult to meet satisfactorily. For example, consider long and mid length putters. They range in length as follows: Long 46, 48 and 50 inches; Mid length 41, 43 and 45 inches. By far, the most common putter lengths are 34, 35 and 36 inches.

(d) The device of U.S. Pat. No. 6,161,691 to Ratcliff; Golf Bag Putter Mount. This patent discloses a putter holder attached to the inside of a golf bag for holding an inverted putter. This is a complex device and can be relatively expensive to manufacture. This "Putter Mount" accepts either blade or mallet head putters. To do so, requires two different receptacles, "Receptacle 30" and "Receptacle 70". A golfer who wishes to change from blade to mallet head putter or vice versa must acquire and install a matching receptacle. There is no provision for protecting the putter shaft (e) The device of U.S. Pat. No. 5,755,322 to Yang, Club Space Assembly for a Golf Club Bag (1998). This patent discloses a highly complex device for attaching to the opening of a golf bag for holding inverted golf clubs. This complex device can be costly to manufacture.

(f) The device of U.S. Pat. No. 5,088,600 to Kopp, Golf Club Shaft Protector Tube (1992). This patent discloses a protective device designed to protect golf club shafts, especial graphite and other exotic material golf club shafts. This device is used inside a golf bag for inverted clubs, including the putter. There is no provision for protecting the putter head from contact with other clubs in the bag.

(g) The device of U.S. Pat. No. 4,838,416 to Carman, Golf Club Holster (1989). This patent discloses a holster for a golf club, particularly a putter. This holster accepts inverted putters and other clubs. The holster may be placed inside a golf bag, inside a pocket on the outside of a golf bag, or attached to a hook on the bag. The Detailed Description of the Invention states: "Portion 6 is contoured, as shown in FIG. 1 and FIG. 3 of U.S. Pat. No. 4,838,416, according to the usual shape of a putter head. The contour of portion 6 may be varied as required". This statement implies that there are special contours required for the various models and makes of putters. In turn, implying that there is not one contour for all putters, but many contours. This holster may be expensive to manufacture. Attaching the holster to a hook or ring on the outside of a golf bag will provide only one anchor point when two are needed. One anchor point on each end of the holster. There is no provision to prevent the holster from swinging freely from a single hook or ring. There is no obvious provision for protecting the putter head from contacting other clubs when the device is placed inside a golf bag.

(h) The device of U.S. Pat. No. 4,932,523 to Yamazoe, Protective Box-Shaped Tube For Inserting A Golf Club Into A Golf Bag (1990). This patent discloses a device used on the inside of a golf bag to hold an inverted putter. The device is attached to existing parallel partition frames inside a golf bag. This device can only be used with golf bags which have parallel partition frames which fit the requirements of the device shown in FIG. 5 of U.S. Pat. No. 4,932,523, latching arms 5a and 5b. This device cannot be used with golf bags which do not have partitioning frames of the required spacing and thickness. FIG. 7 of U.S. Pat. No. 4,932,523, shows a portion of a putter that is exposed on the inside of a golf bag. Such exposure invites contact with other golf clubs inside the golf bag.

(i) The device of U.S. Pat. No. 3,985,229 to Maid, Detachably Interlinked Reinforced Tubular Golf Club Protectors (1976). This patent discloses a set of interlinked tubular golf club protectors that are used inside a golf bag. Inverted golf clubs, putter included, are inserted into the protectors and the shafts are protected by the tubular receptacles. The heads of clubs, putter included, are exposed to other clubs inside the golf bag. This invites contact between club heads inside the golf bag. There is no provision for protecting the head of a putter or other golf club.

(j) The device of U.S. Pat. No. 4,350,194 to Brown, Universal Golf Bag (1981). This patent discloses a bag for carrying golf equipment, including a plurality of fasteners and several elongated external appendages one of which could be used to hold a golf club. This device is a complete golf bag for carrying a set of golf clubs. It is much more than a putter holder and would be costly.

(k) The device of U.S. Pat. No. 6,375,004 to Tuerschmann and Schmidt, Golf Bag With Putter Storage Compartment (2002). This patent discloses a golf bag which includes a putter storage compartment which is separate from a main golf club storage compartment and is disposed in an elongated pocket which is normally provided on golf bags and is commonly referred to as a clothing pocket. The bottom of the puffer storage compartment is a plurality of inches above the bottom of the golf bag, while the top of the putter storage compartment is a plurality of inches below the top of the golf bag. Provision is made to prevent an inverted putter from protruding below the bottom of the putter storage compartment. However, any standard length putter which is inverted and then inserted into the putter storage compartment will extend well above the top of the compartment and indeed well above the top of the golf bag. There is no obvious provision for protecting the putter head from contacting other golf clubs contained in the main golf club storage compartment. This device is a complete golf bag for carrying a set of golf clubs. Such bags can be seen in sporting goods stores, discount stores and pro shops. The cost of such a device will be relatively expensive and may well provide less protection than other devices.

STATEMENT OF THE PROBLEM

Three major objectives are inherent in the task of improving putter holders. They are: providing protection for a putter; making a puffer easier to locate and access; making a less complex putter holder that costs less to manufacture.

(a) Providing protection for a putter during a round of golf.

1. During a round of golf, golf clubs are transported in golf bags via pull carts, golf cars or physically carried by a golfer or a caddie. Clubs carried in a golf bag during a round can be jostled, bounced, dropped and are otherwise in constant motion during transportation. During a round, golf clubs that contact each other may inflict what is usually minor or cosmetic, but cumulative damage.

(b) Making a putter easier to locate and access, during a round of golf.

1. A putter that resides inside a golf bag, along with thirteen or so other golf clubs, must be located, accessed and removed by a golfer when preparing to putt. After putting, the golfer must reverse this process and return the putter to the golf bag alongside the other golf clubs. The golfer must locate, retrieve and replace the putter as many as eighteen times in each and every round of golf. These activities are repetitive and time consuming.

(c) Making a putter holder that costs less to manufacture.

1. Prior Art has produced putter holders with only one part and others with many parts. Manufacturing costs of Prior Art putter holders range from low to high.

These objectives have been partially met by new devices and new inventions. However, present inventions leave considerable room for improvement. My invention meets or exceeds the objectives. My invention is simple, not complex. It makes a putter easy to locate and easy to access. It protects putters, it saves golfers time and is less costly to manufacture.

OBSERVATIONS TOWARD PROBLEM RESOLUTION

A balance is required between three major objectives: protecting a putter; making the putter readily and easily accessible; and low manufacturing costs.

(a) One must realize that golf clubs are tough customers and subject to damage during a round of golf. They are used to strike golf balls, sand and turf. They are designed for high velocity contact with stationary golf balls, sand, turf and an occasional pebble, rock or other hard object. Putters, on the other hand, are designed to strike a stationary golf ball at low velocity. Some putter heads are made of brass or other relatively soft material. Others are of harder materials. Some golfers protect their clubs with tubes, socks or other covers. Some golfers cover their putter heads with especially shaped removable, protective covers.

1. The point being, that not all putters need additional protection. Some will be protected due to a golfer's own initiative. Putters need protection, but not overkill. There are two ways to protect a puffer, direct and indirect protection. Direct protection employs a protective covering for the putter head and/or shaft. Indirect protection separates or isolates both the puffer head and shaft from contact with other golf clubs.

(b) A golfer must locate, retrieve and replace the putter as many as eighteen times during each and every round of golf.

1. The location of a putter carried in an external putter holder is obvious. It is easily and readily accessible, for removal from the holder, and for replacement in the holder.

(c) The cost of manufacturing putter holders varies significantly.

1. Costs can be reduced by inventing simpler, more effective putter holders with fewer and less expensive parts.

My Putter Pal Putter Holder is novel and unique. It is a considerable improvement over prior inventions. It meets or exceeds objectives for protecting a putter. It protects the putter handle, shaft and head. It protects the putter from contact with other golf clubs. It makes locating, accessing and storing a putter quick and easy. My putter holder can be produced at low cost. My putter holder provides an optimum balance between the objectives; protection, accessibility and cost.

OBJECTS AND ADVANTAGES

Accordingly, besides the objects and advantages stated above, several objects and advantages of my invention are to provide a putter holder that:

(a) is novel, unique, effective, simple, removable and inexpensive;

(b) is attached to the outside, rather than the inside, of a golf bag;

(c) can be attached in place of a golf umbrella;

(d) isolates and physically separates a putter from other golf clubs;

(e) is made of a small number of parts;

(f) can be made wholly or partly from low cost, off-the-shelf items;

(g) costs less to manufacture;

(h) presents a large surface area for reception and display of advertising, print, logos, art and other visual aids;

(i) protects the putter shaft and handle;

(j) protects the putter head;

(k) is stylish and attractive.

Further objects and advantages are to provide a unique putter holder which is easy and convenient to use, which protects putters of various lengths and designs, which can be attached to and removed from a golf bag, which can be made from a choice of sizes of readily available flat plastic drainage hose. A variety of fastening devices can be chosen to attach the putter holder to a golf bag. These choices include hook-and-loop type fasteners, belts, straps, clips, hooks, grommets or combinations thereof. Additional significant objects and advantages are clearly presented in the drawings and the detailed description.

SUMMARY

Accordingly, it is an object of this invention to provide a golf putter holder that is capable of holding a variety of putters or other golf clubs or implements.

(a) It is a further object of this invention to provide a golf putter holder made from a plurality of sizes of well known flat plastic drainage hose or other materials which lend themselves to forming sleeve like covers and holders with tabs.

(b) It is yet a further object of this invention to provide an attractive golf putter holder that can be made from a variety of natural or synthetic fabrics in the form of a hollow, open-ended, flat or tubular sleeve with tabs.

(c) It is yet a further object of this invention to provide a golf putter holder that can be removably or permanently attached externally to a golf bag by a plurality of fastening devices which are well known in the art, such as, hook-and-loop fasteners, belts, and hooks.

(d) It is yet a further object of this invention to provide a golf putter holder that can be easily attached to the exterior surface of a golf bag and can also be easily detached.

The invention can be summarized as a stylish, attractive, low cost, removable golf putter holder which is attached externally to a golf bag. Which holds, isolates and protects a golf club or other implement during a round in the game of golf, and which renders the golf club or other implement readily and conveniently accessible by a golfer.

LIST OF DRAWING FIGURES

Drawings

The drawings have portrait orientation. Sight is 17.5 cm by 24.4 cm. Invisible margins are: top 2.5 cm, left 2.5 cm, right 1.5 cm and bottom 1.9 cm. Cross hairs are at upper left and lower right corners of the invisible margins. In the drawings, figures showing related configurations have different numbers but the same alphabetic suffixes. For example:

(a) FIG. 1A is a perspective view of a putter holder attached externally to a golf bag by means of a hook and a belt, (b) FIG. 9A is a sectional view of FIG. 1A, (c) FIG. 11A is a perspective view of a putter holder attached externally to a golf bag by means of a hook-and-loop fastener and a belt.

DRAWING FIGURES LIST

Preferred Embodiment

FIG. 1A a perspective view of a putter holder attached to a golf bag via a hook and a belt.

A Second Embodiment

Figure 11A:
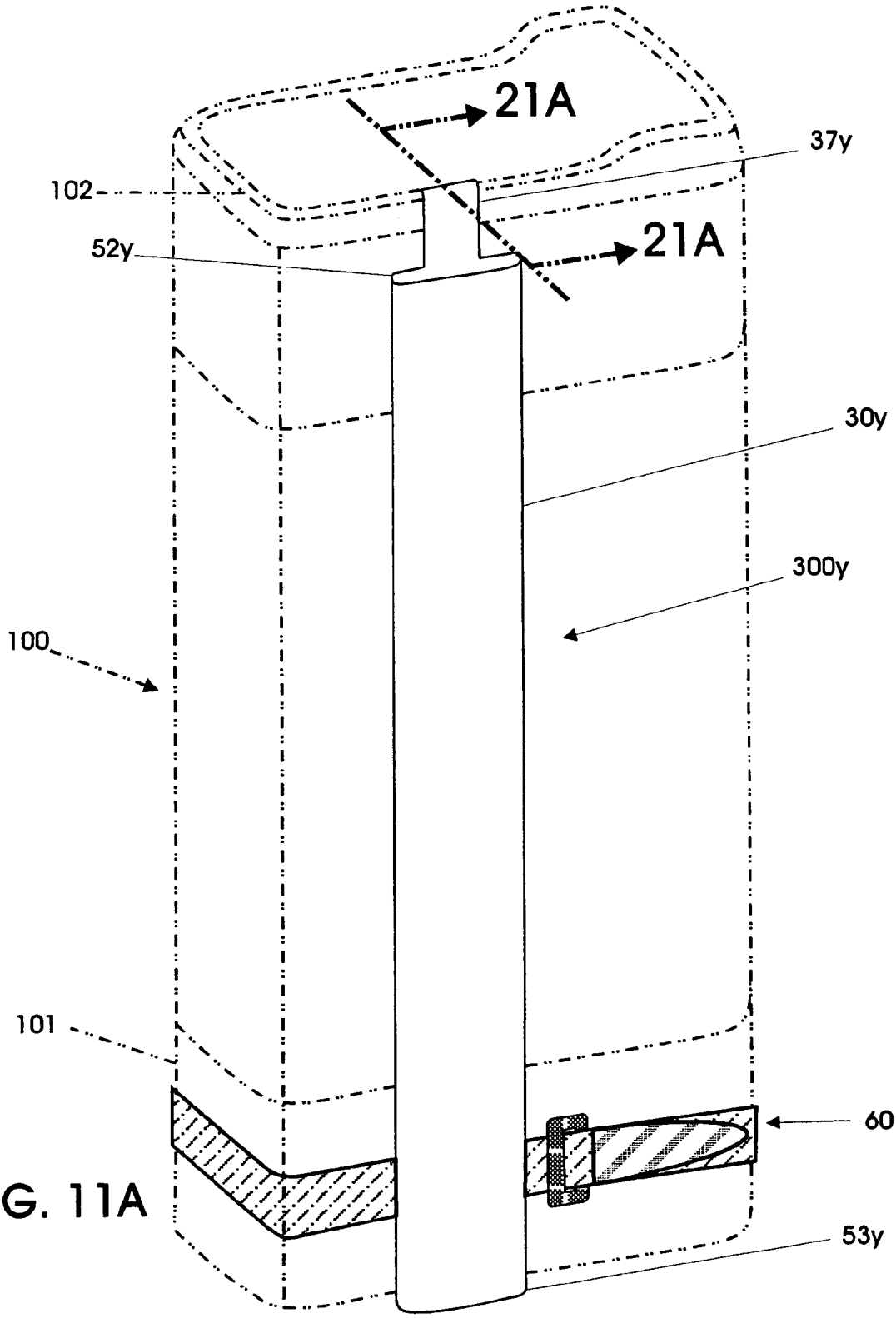

FIG. 11A a perspective view of a putter holder attached to a golf bag via a hook-and-loop fastener and a belt.

Figure 12A:
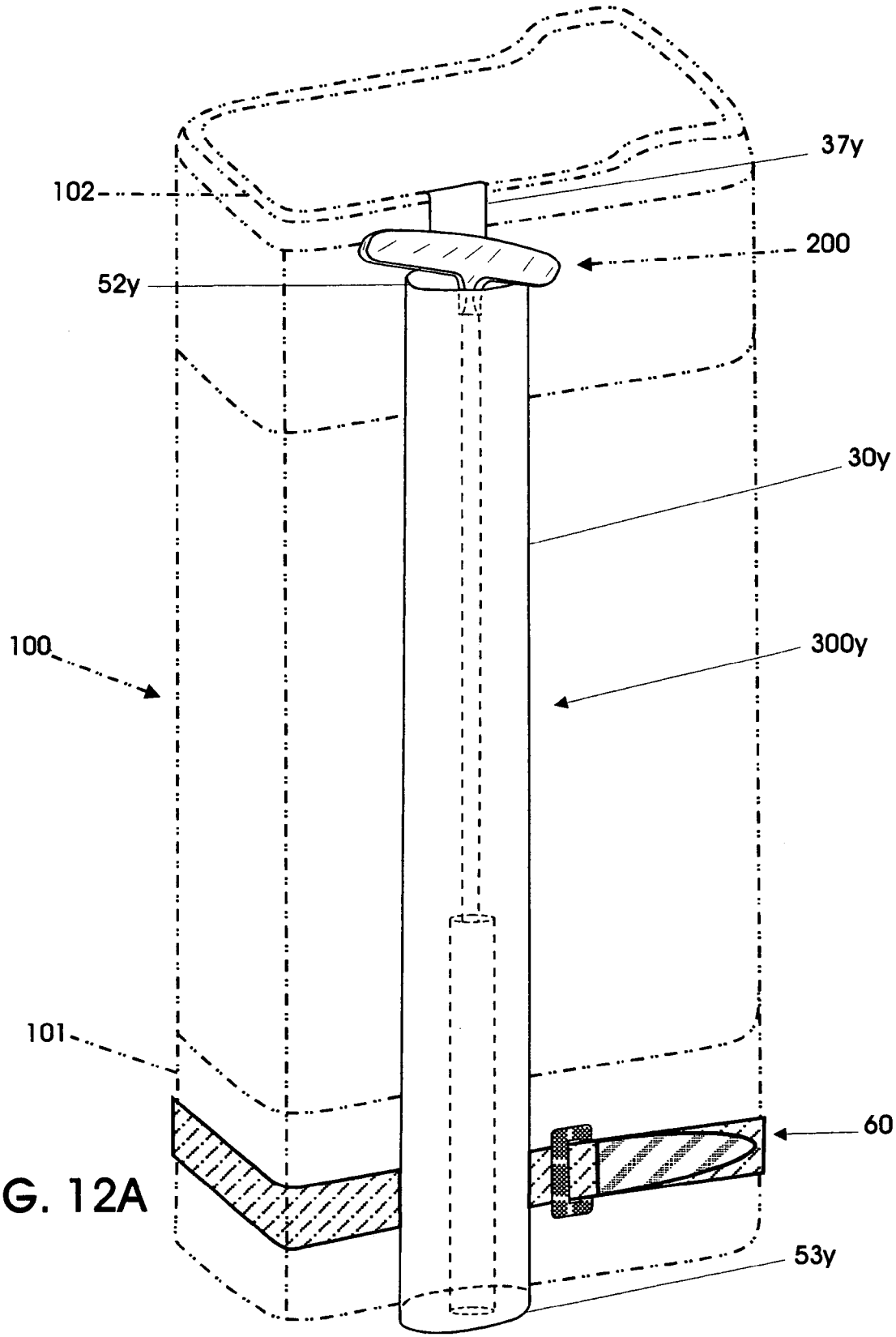

FIG. 12A shows FIG. 11A with an inverted putter inserted into the putter holder.

Figure 13E:
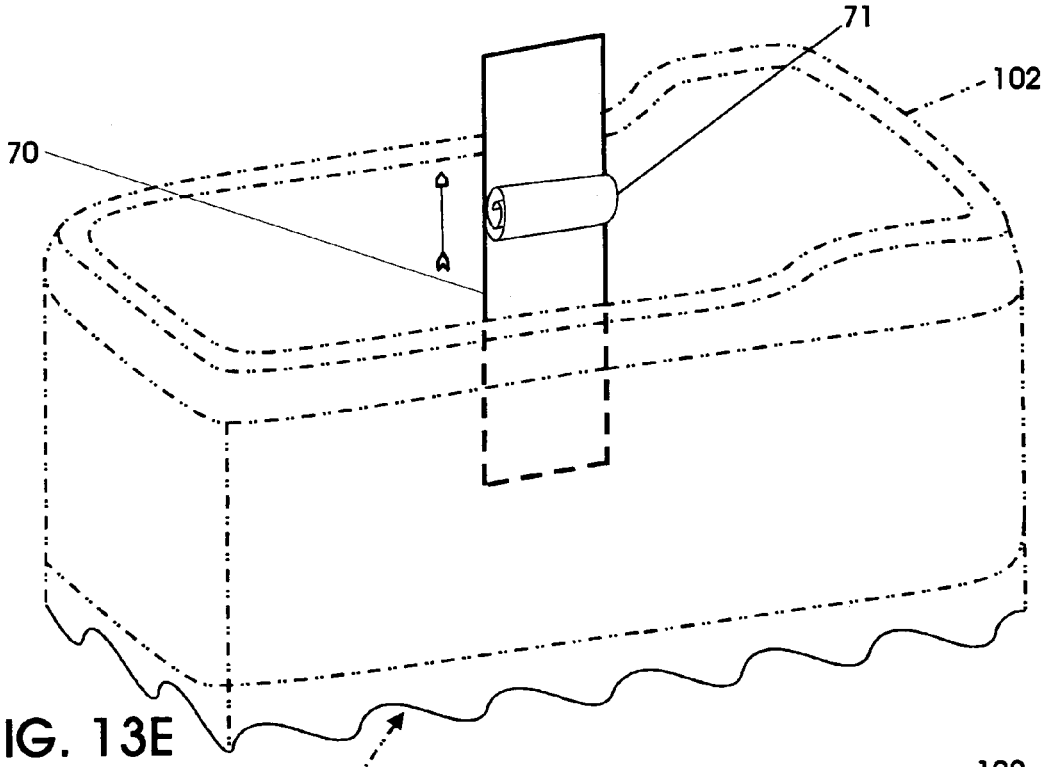

FIG. 13E shows the hook part of a hook-and loop fastener being attached with adhesive to the upper portion of a golf bag.

Figure 14E:
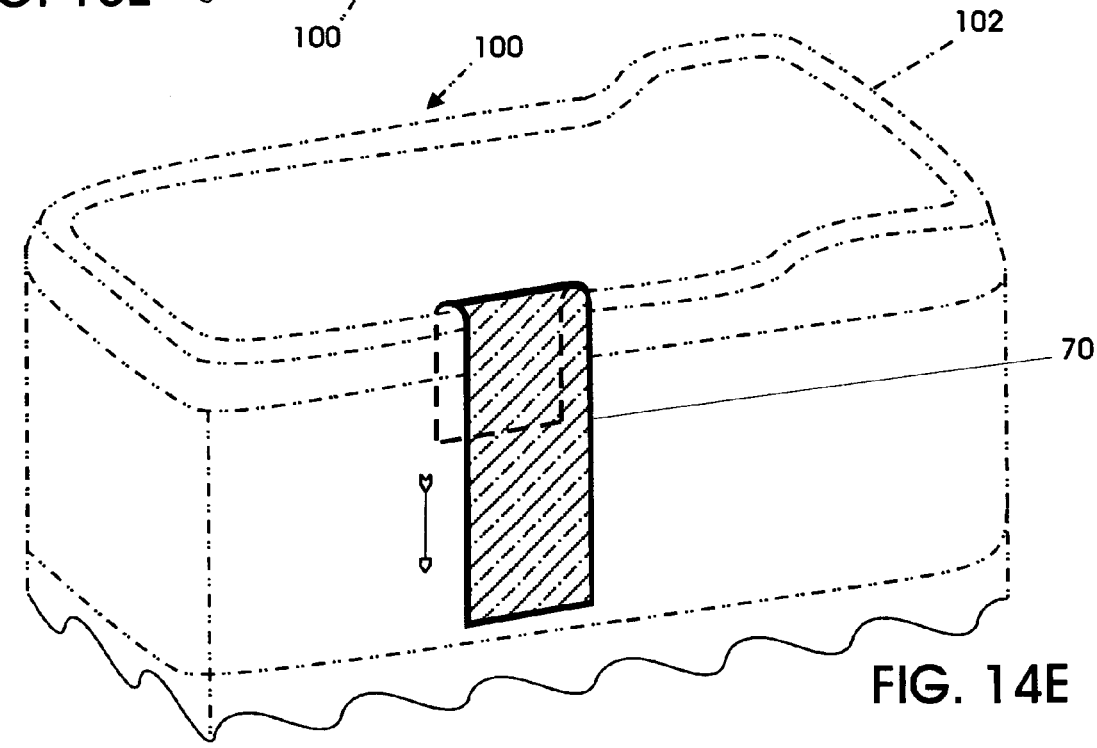

FIG. 14E shows the hook part of a hook-and loop fastener attached to the upper portion of a golf bag.

Figure 15B:
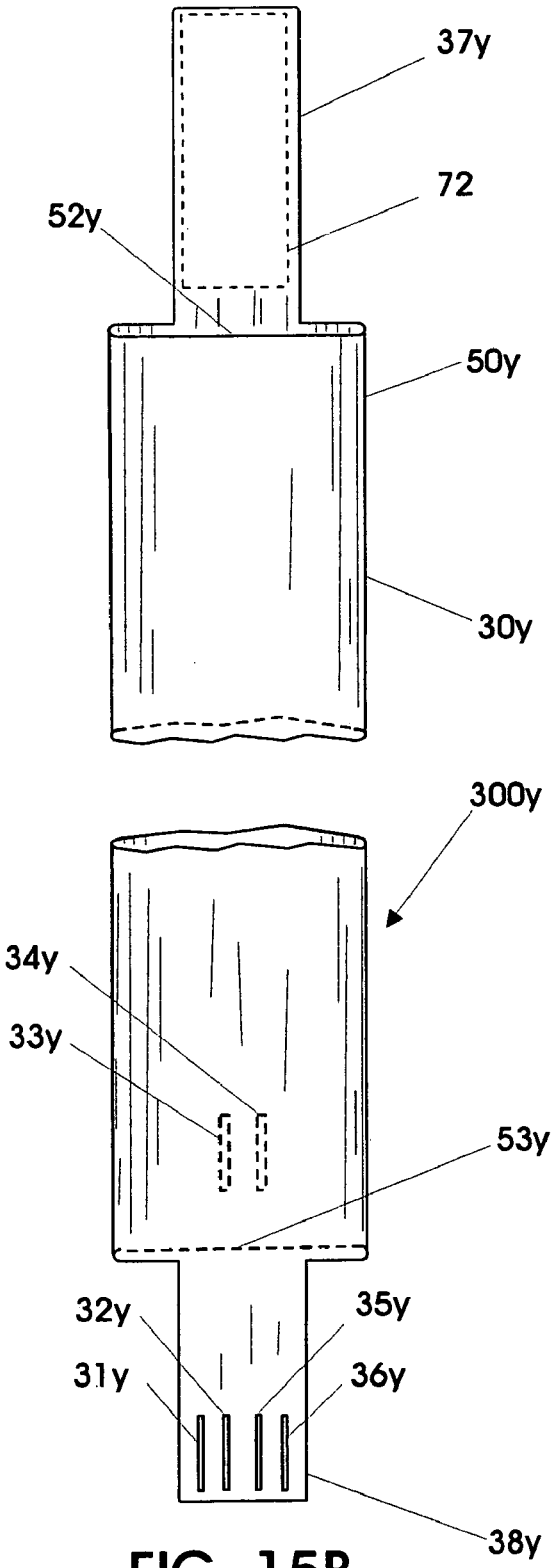

FIG. 15B shows a front view of a sleeve with the loop part of a hook-and-loop fastener attached.

Figure 16B:
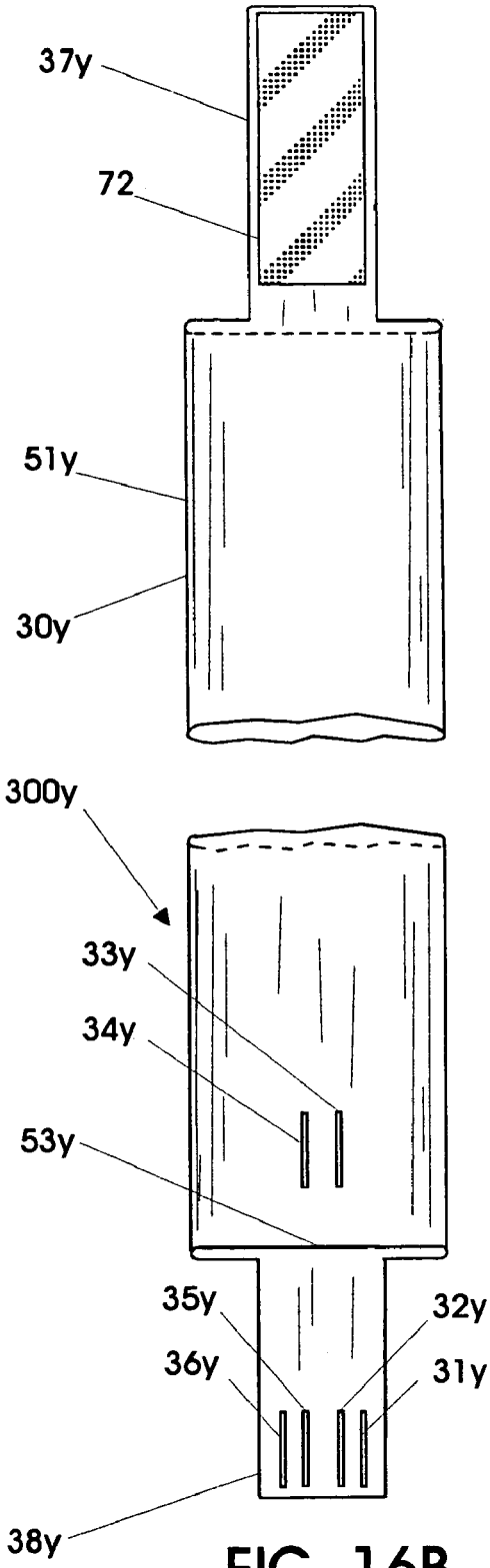

FIG. 16B shows a rear view of a sleeve with the loop part of a hook-and-loop fastener attached.

Figure 17B:
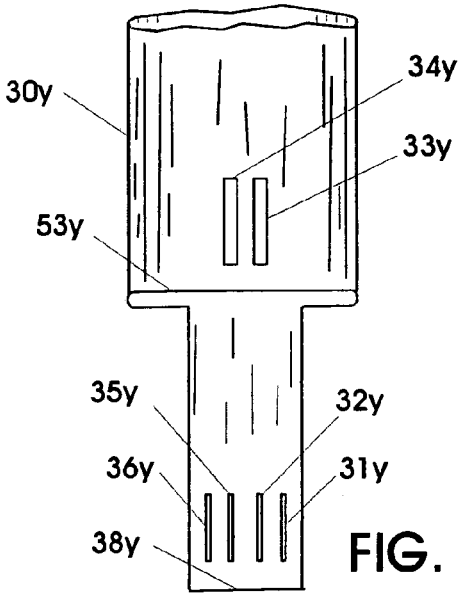

FIG. 17B shows a partial rear view of the bottom part of a sleeve with slits and its tab with slits.

Figure 18B:
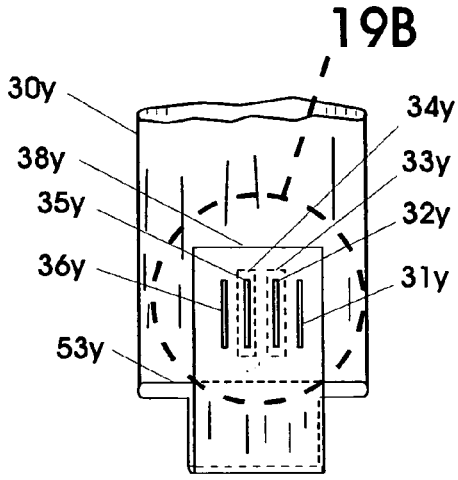

FIG. 18B shows FIG. 17B with the sleeve's tab folded over the sleeve and its two central tab slits adjacent and parallel to the two sleeve slits.

Figure 19B:
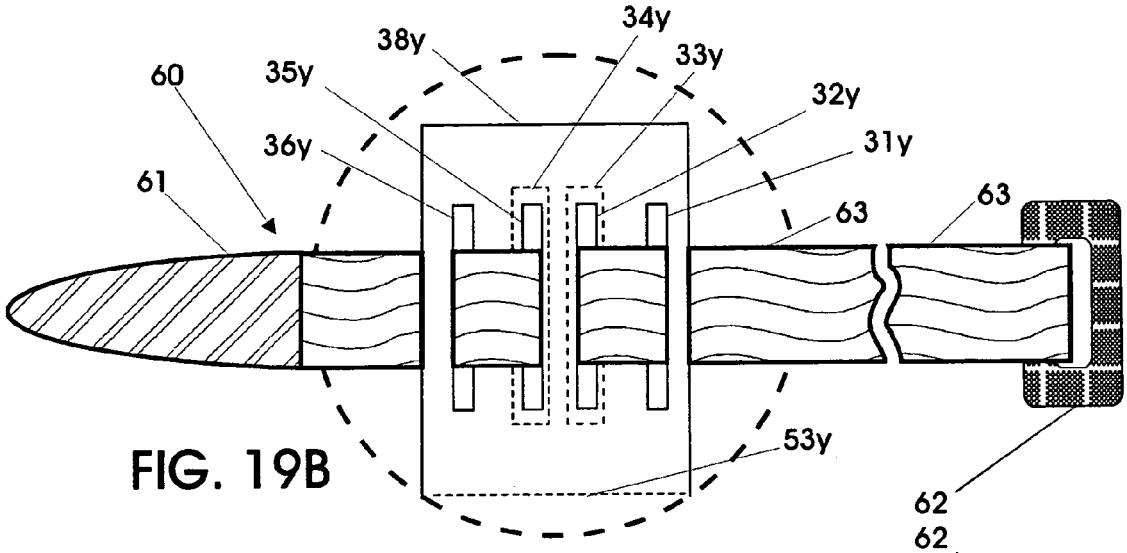

FIG. 19B shows an enlarged view of a portion of FIG. 18B with a belt threaded through the four tab slits and the two sleeve slits.

Figure 8C:
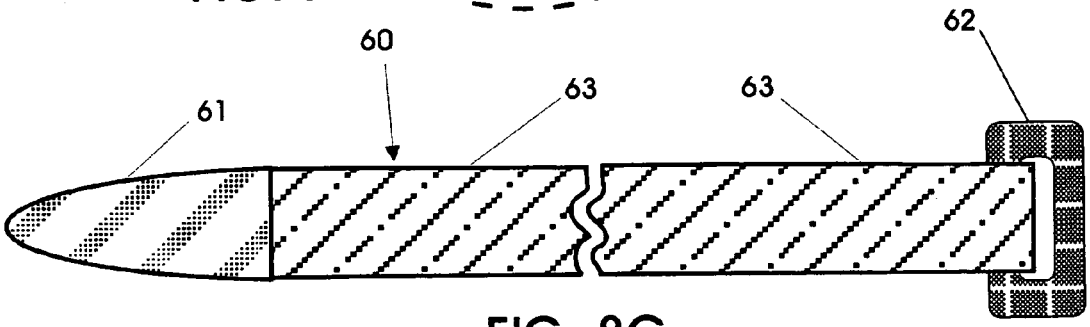
FIG. 8C shows a belt used to fasten the bottom portion of a sleeve to the boot of a golf bag.
Figure 20C:
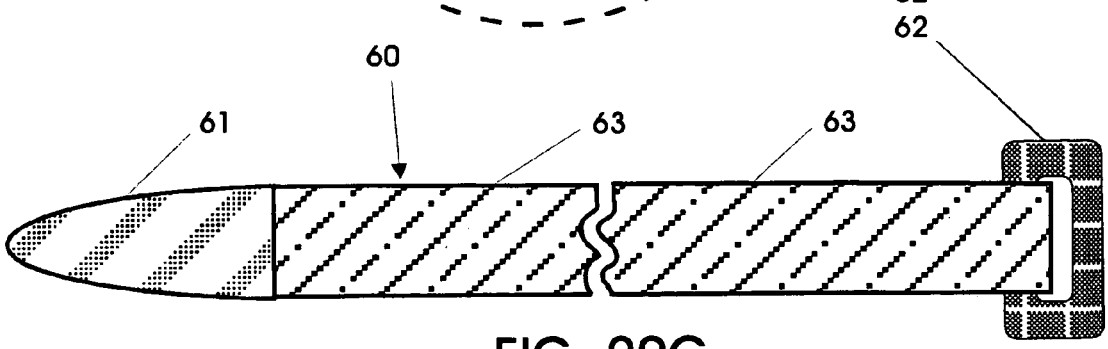

FIG. 20C is a duplicate of FIG. 8C.

Figure 21A:
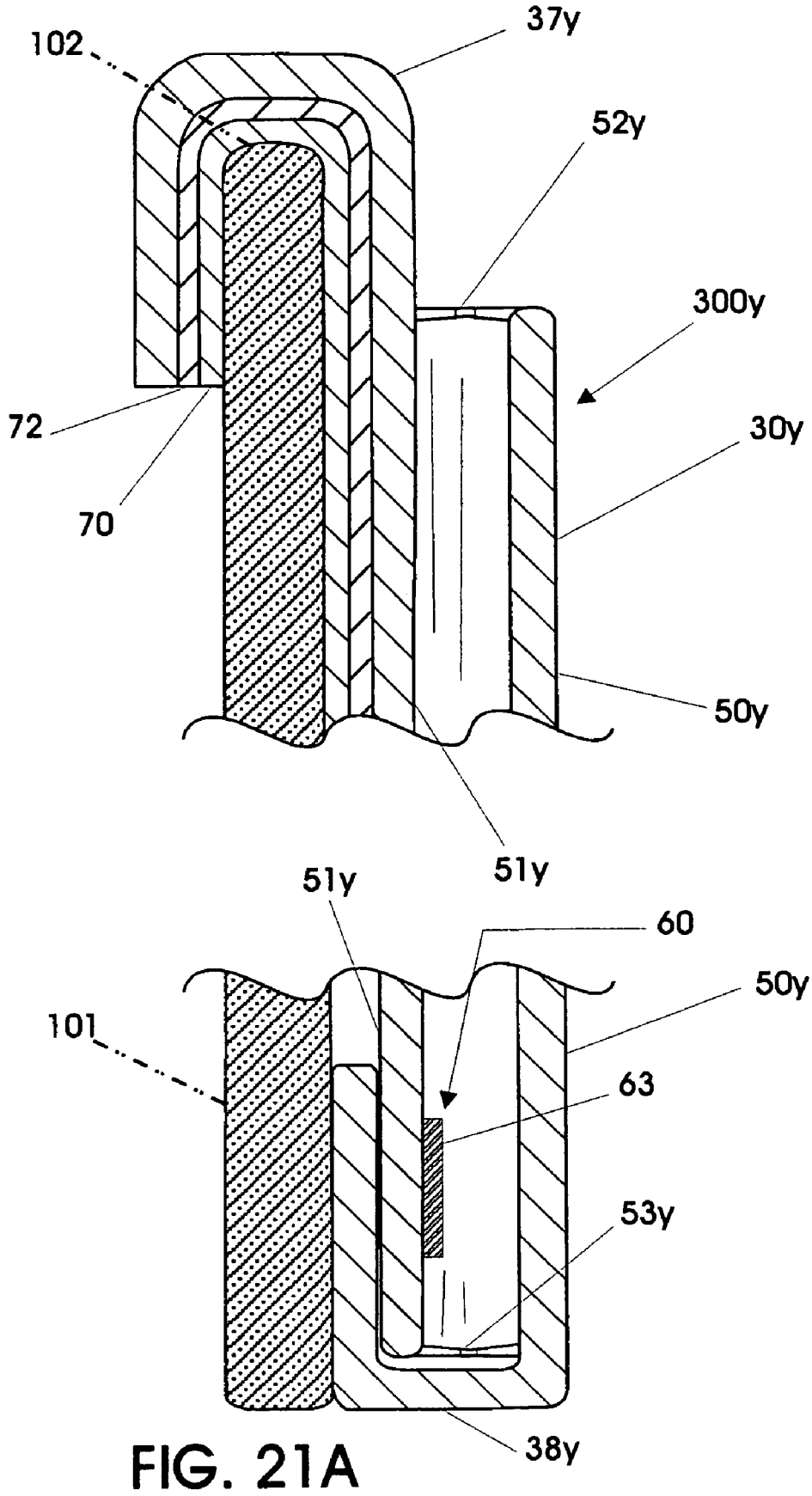

FIG. 21A shows a sectional view of FIG. 11A.

A Third Embodiment

Figure 22A:
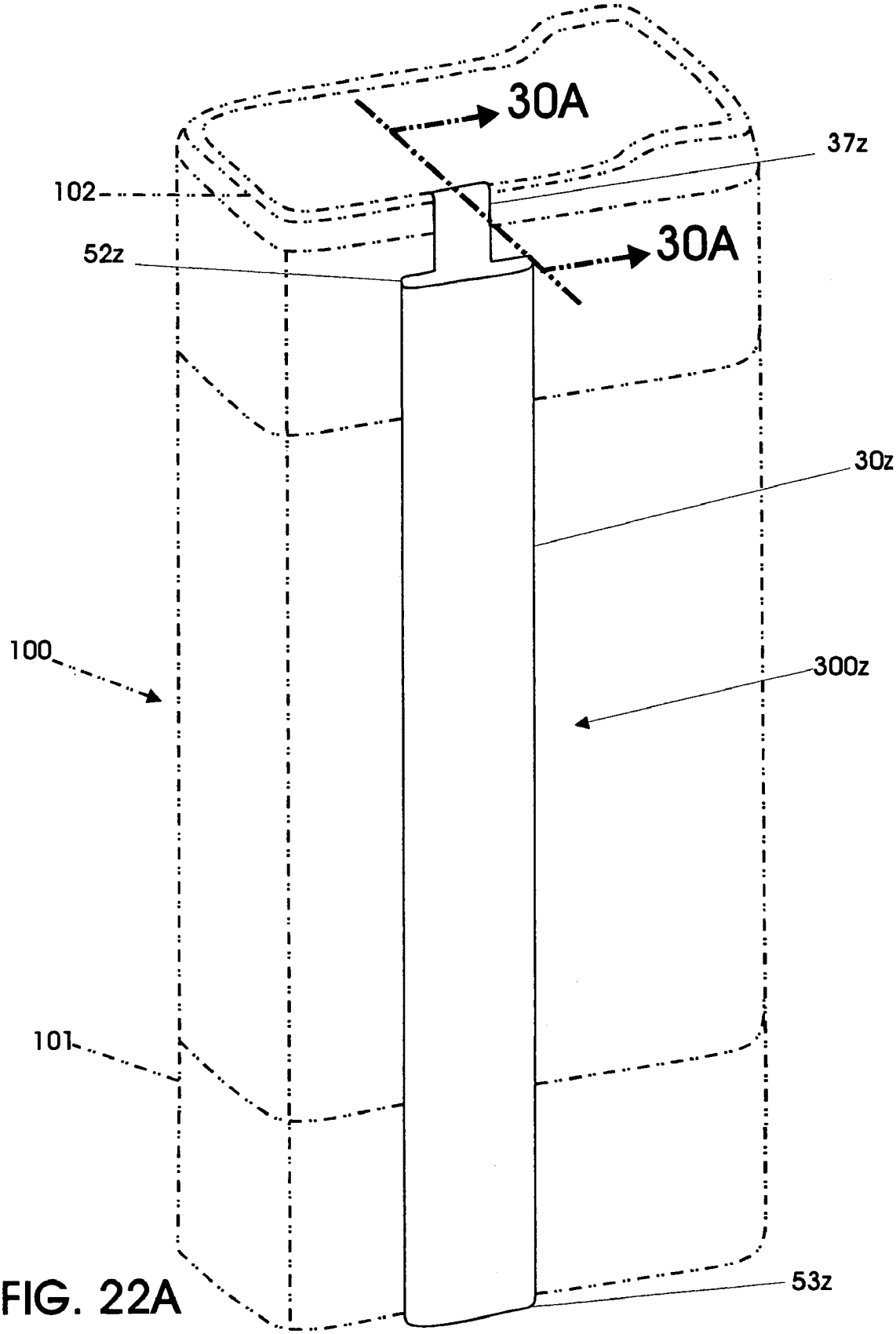

FIG. 22A a perspective view of a puffer holder attached to a golf bag via hook-and-loop fasteners.

Figure 23A:
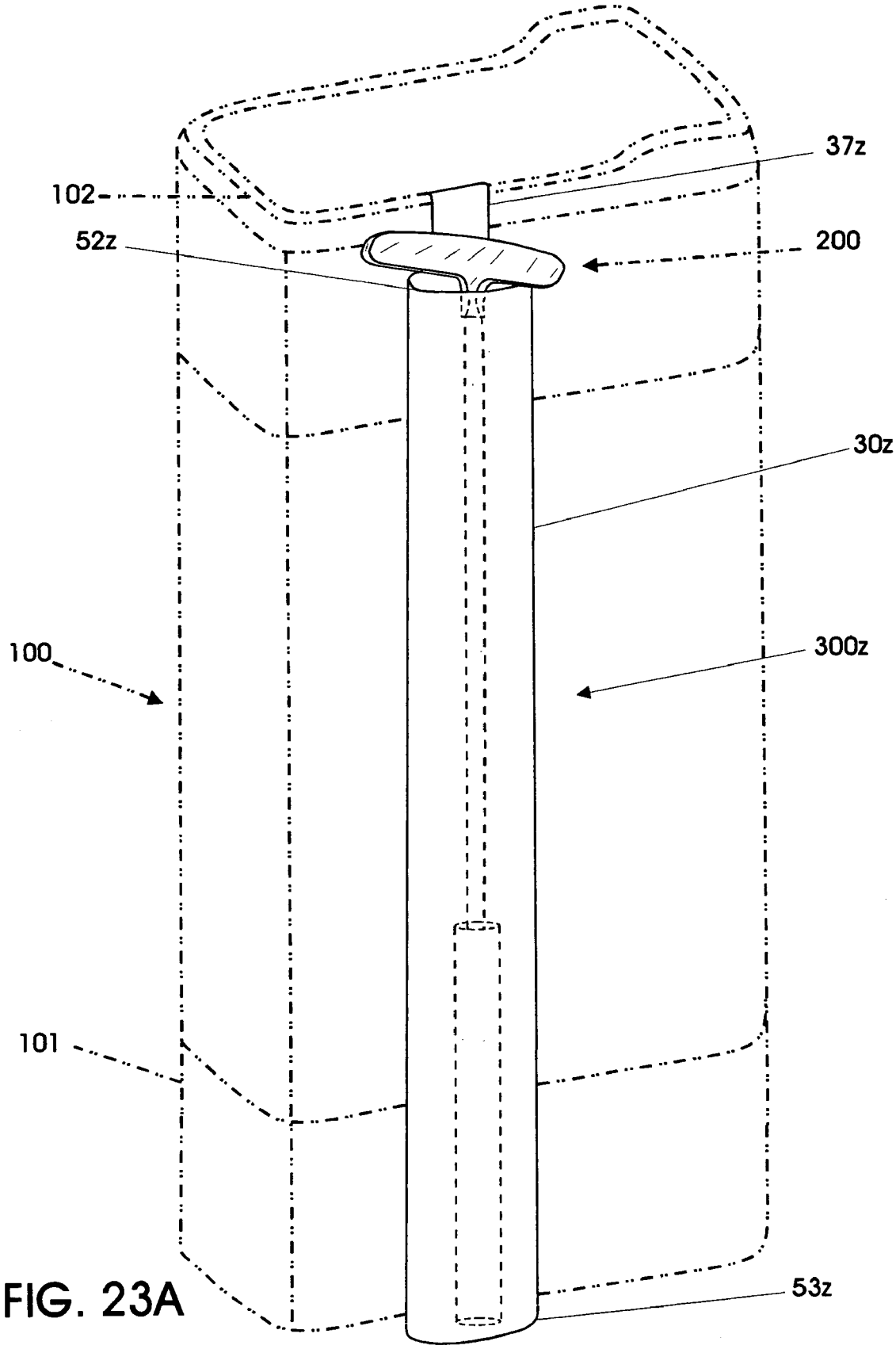

FIG. 23A shows FIG. 22A with an inverted putter inserted into the putter holder.

Figure 24F:
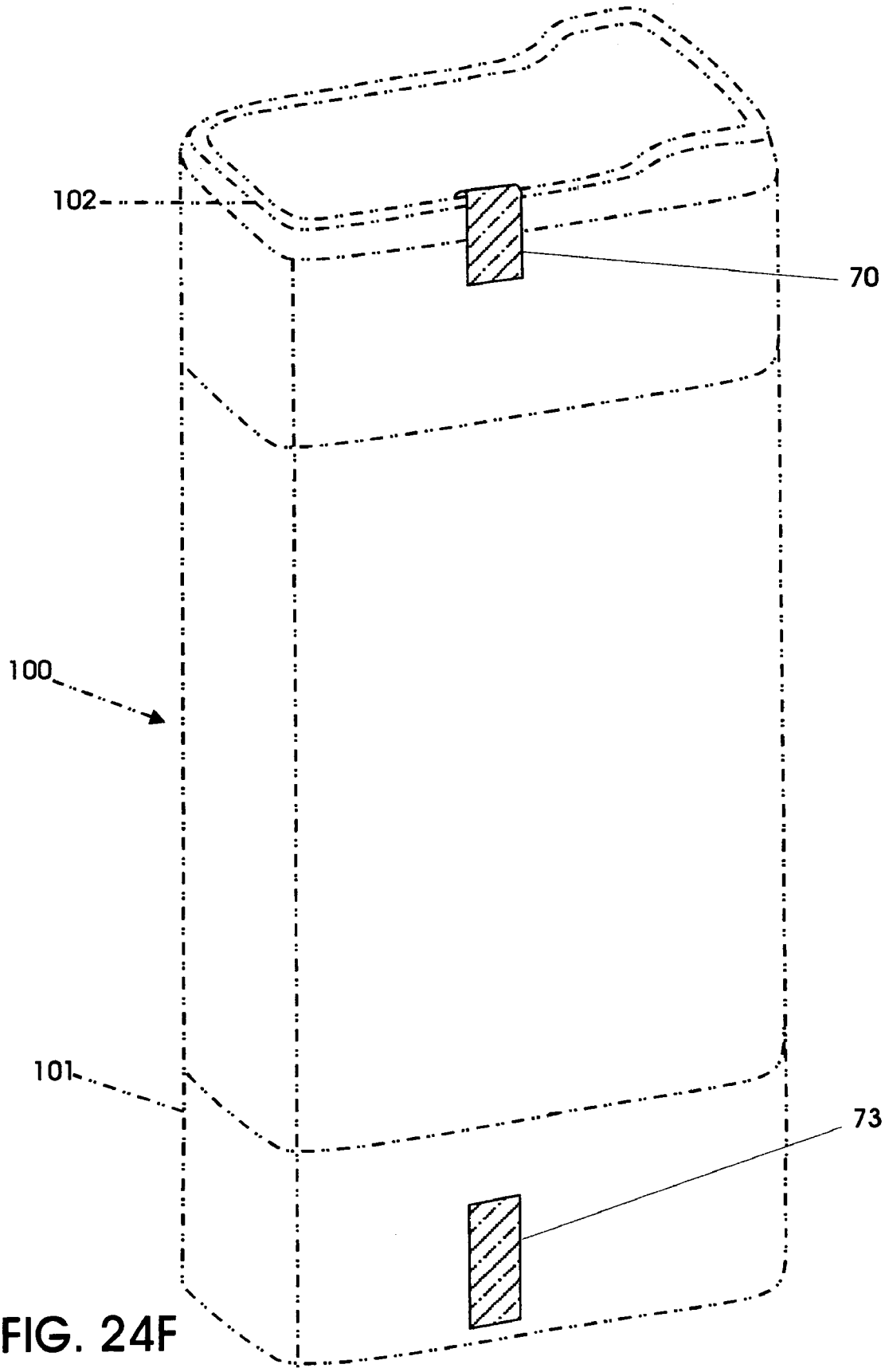

FIG. 24F shows the hook parts of a hook-and-loop fastener attached with adhesive to both the upper portion and the lower portion or boot of a golf bag.

Figure 25B:
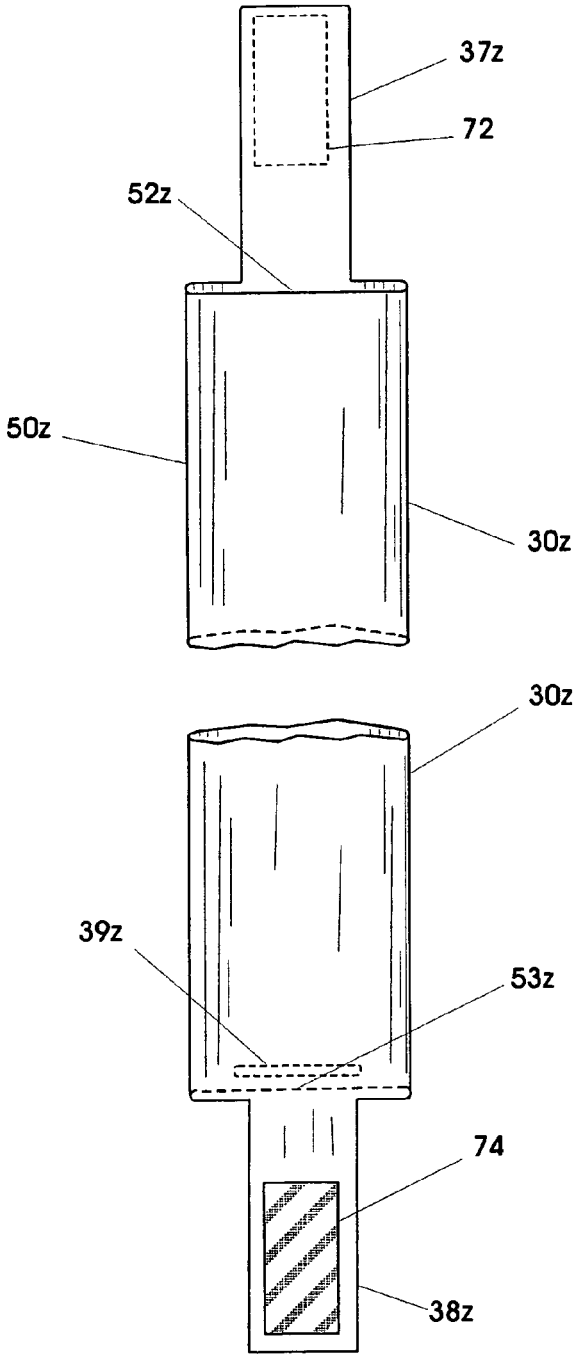

FIG. 25B shows a front view of a sleeve with the loop parts of a hook-and-loop fastener attached to both the upper and lower tabs of the sleeve.

Figure 26B:
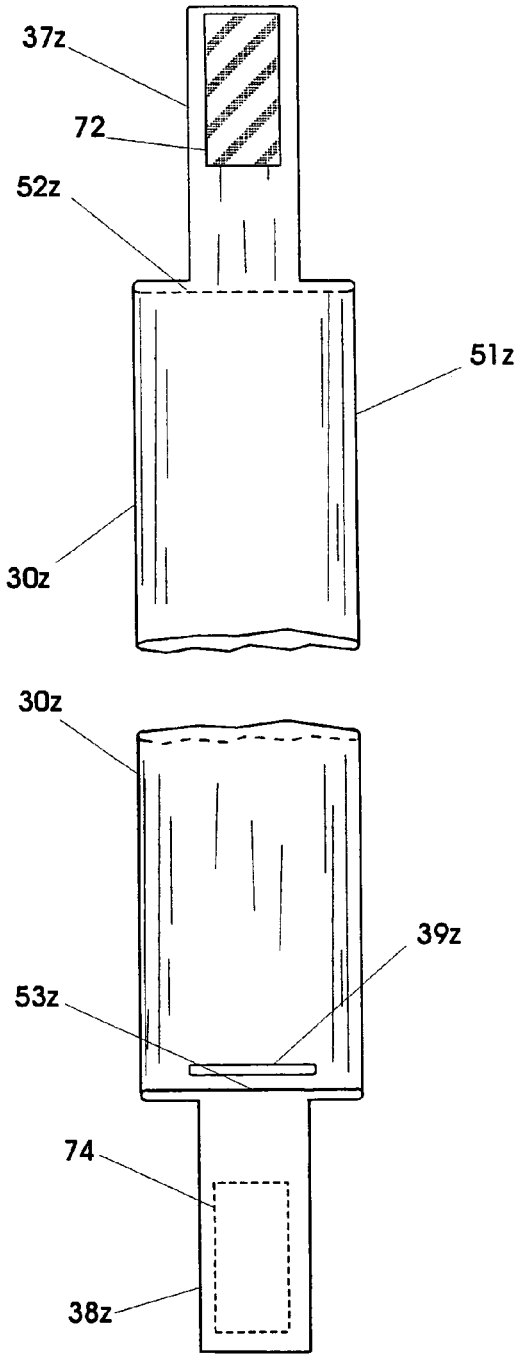

FIG. 26B shows a rear view of FIG. 25B.

Figure 27B:
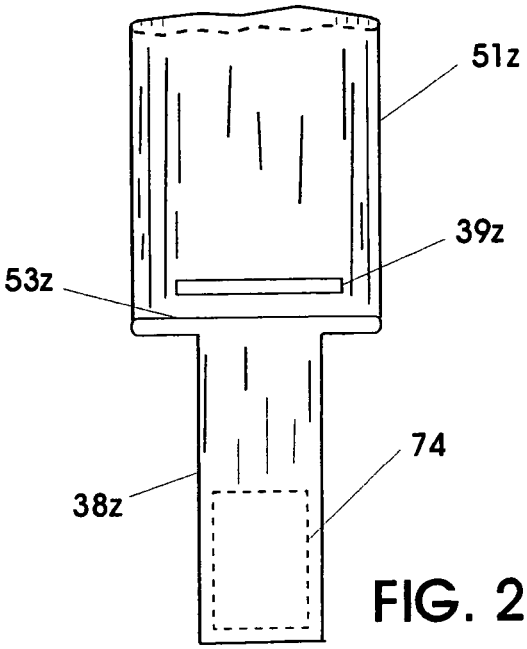

FIG. 27B shows a partial rear view of the bottom part of a sleeve with its slot and with the loop part of a hook-and-loop fastener attached to the bottom tab of the sleeve.

Figure 28B:
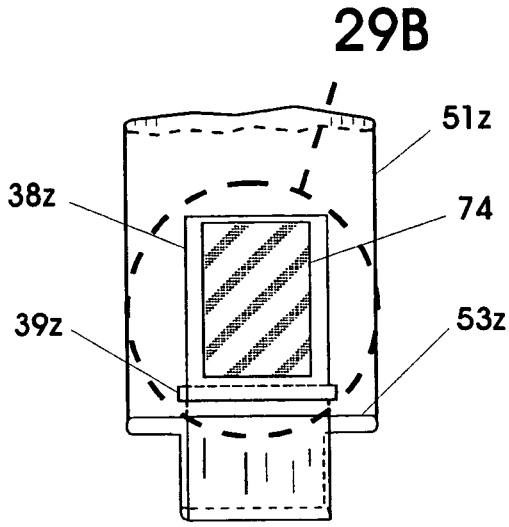

FIG. 28B shows FIG. 27B with the sleeve's tab folded over, threaded through the sleeve slot, and with the loop part of a hook-and-loop fastener attached to the bottom tab of the sleeve.

Figure 29B:
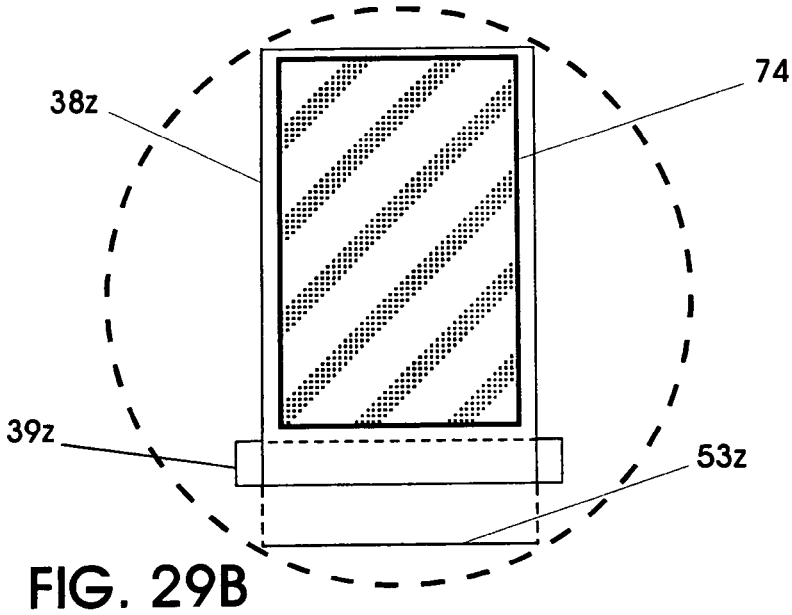

FIG. 29B shows an enlarged view of a portion of FIG. 28B.

Figure 30A:
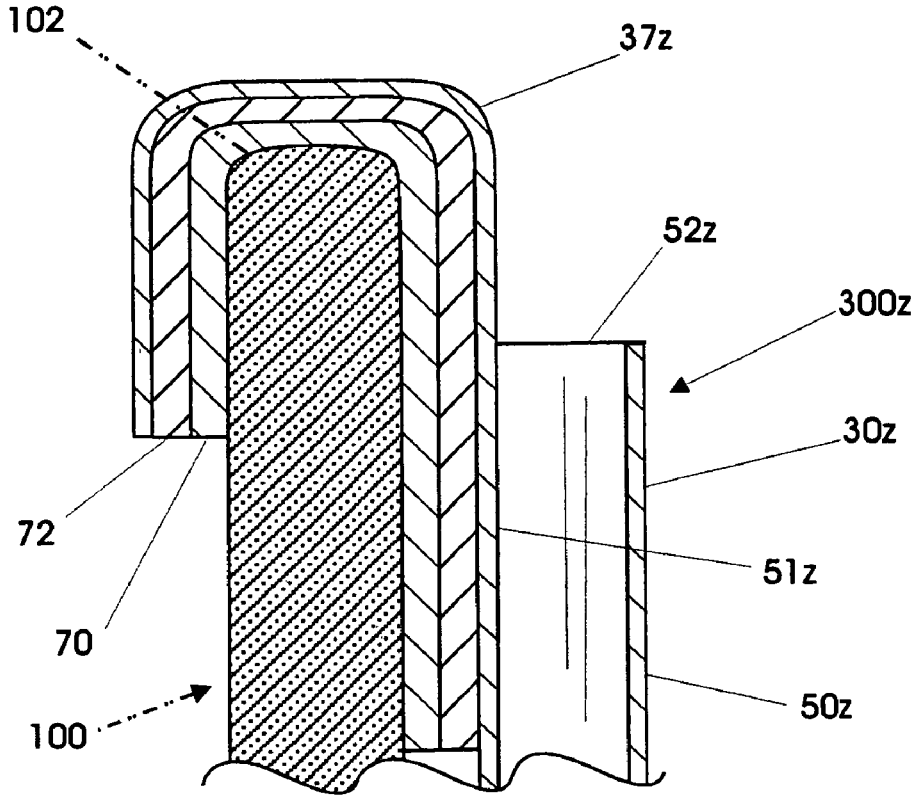
Figure 30A:
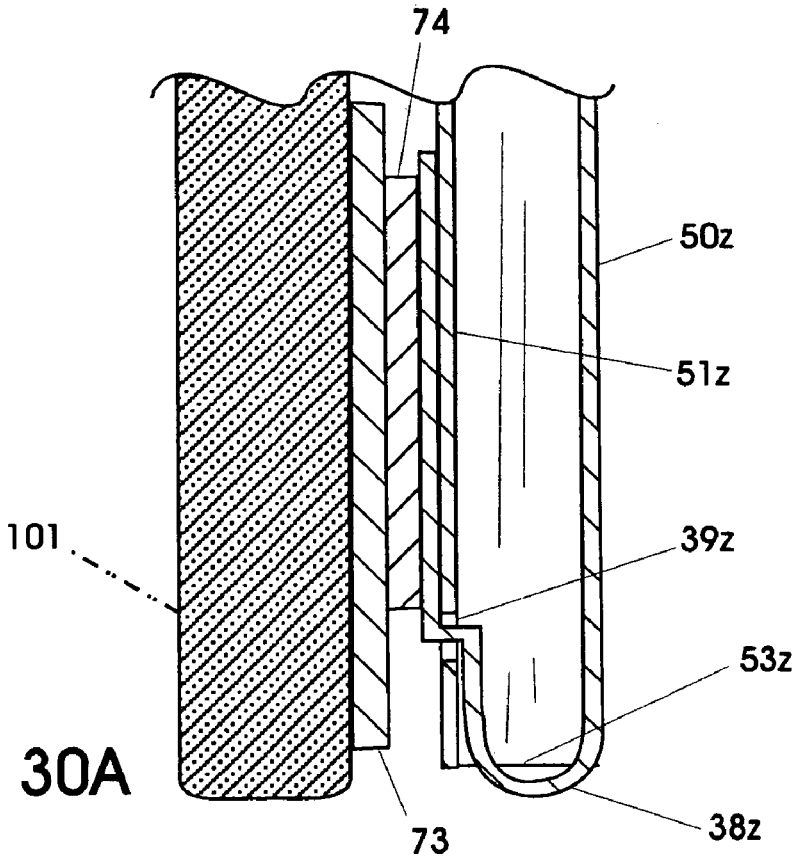

FIG. 30A shows a sectional view of FIG. 22A.

A Fourth Embodiment

Figure 31G:
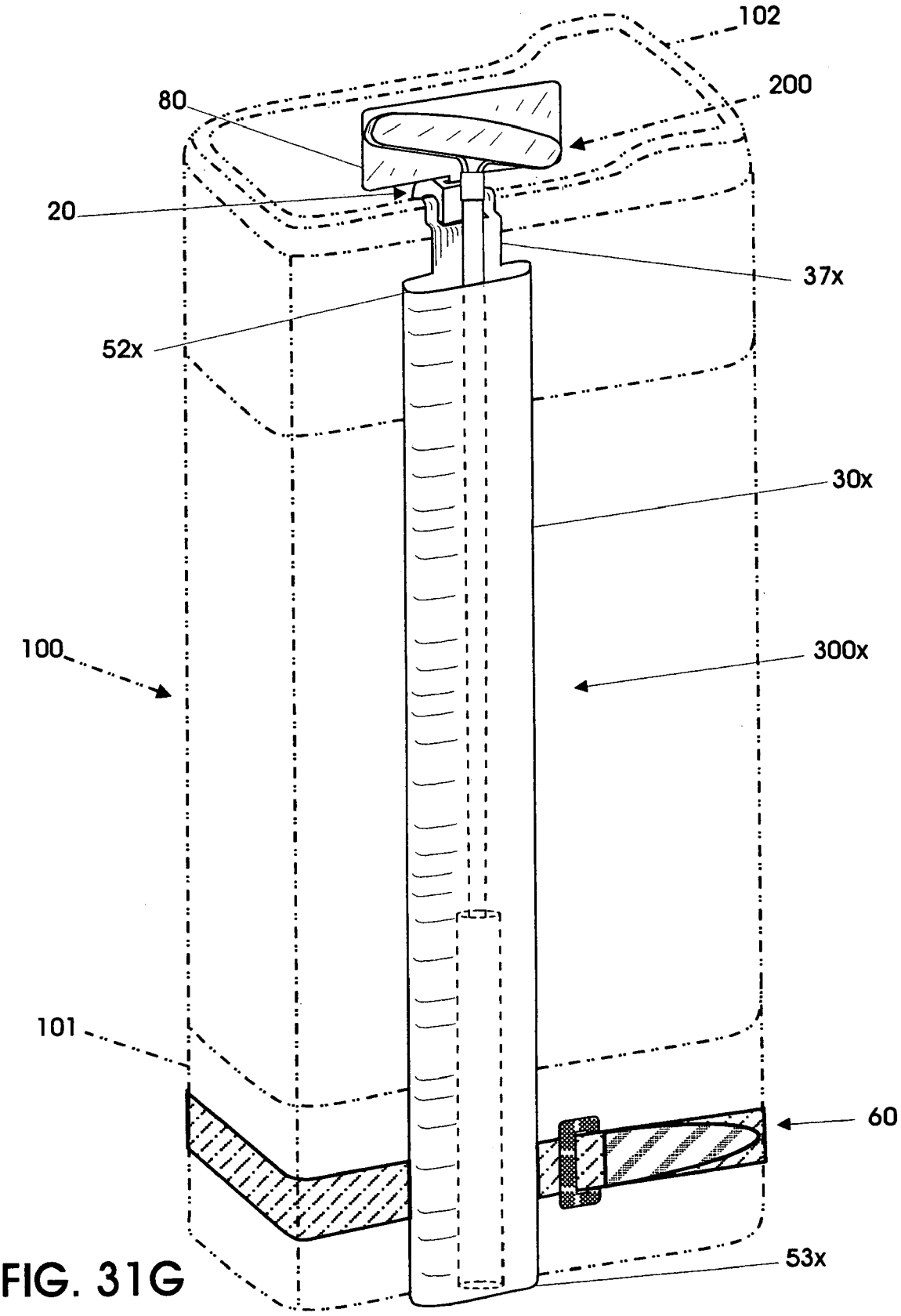

FIG. 31G is a perspective view of a putter holder attached to a golf bag via a hook-with-slot and a belt, a protective plate attached to the hook-with-slot, and an inverted putter inserted into the putter holder.

Figure 32G:
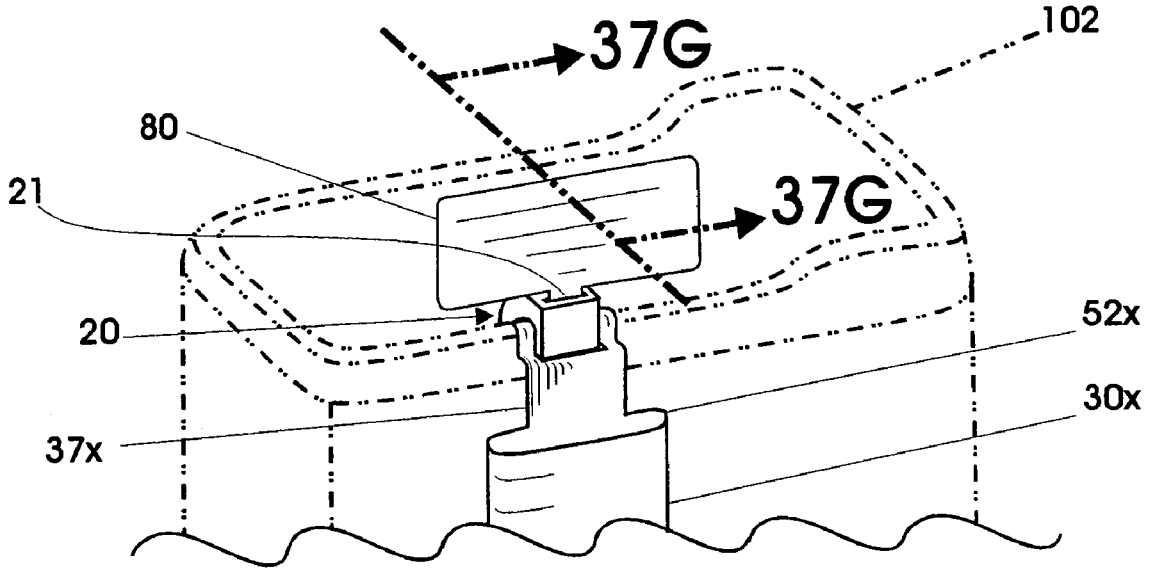

FIG. 32G is a partial perspective view of the upper portion of FIG. 31G with the putter removed.

Figure 33G:
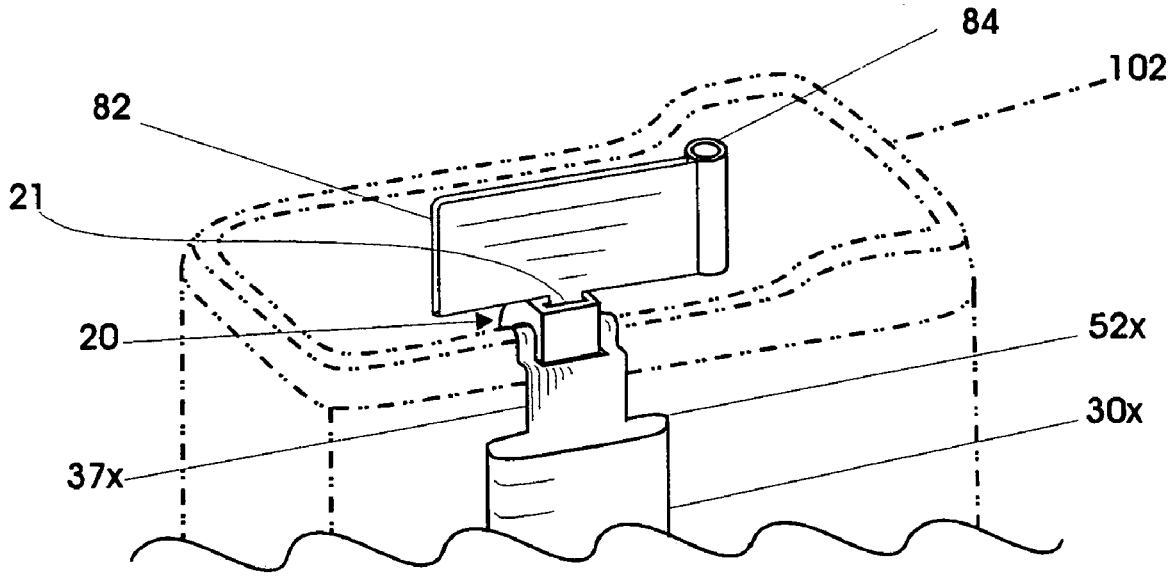

FIG. 33G is a duplicate of FIG. 32G with the protective plate removed and a protective plate with scorecard and pencil holder attached to the hook-with-slot.

Figure 34G:
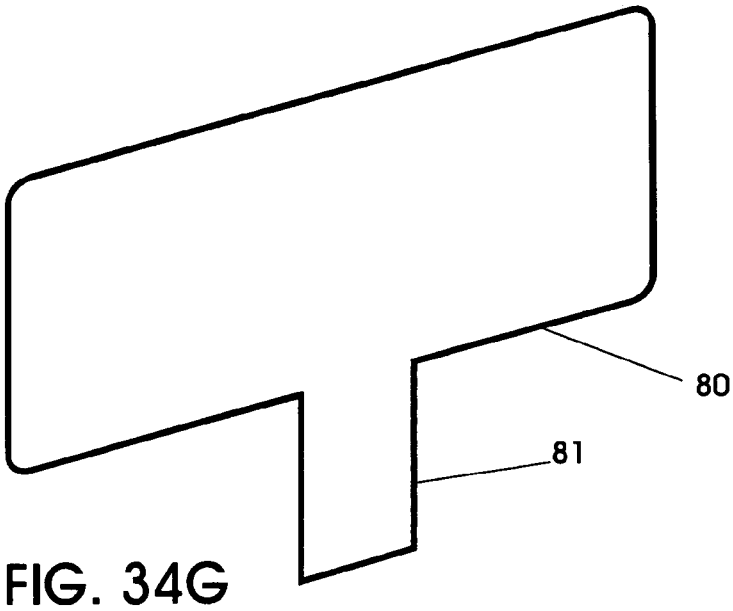

FIG. 34G is a perspective view of a protective plate.

Figure 35G:
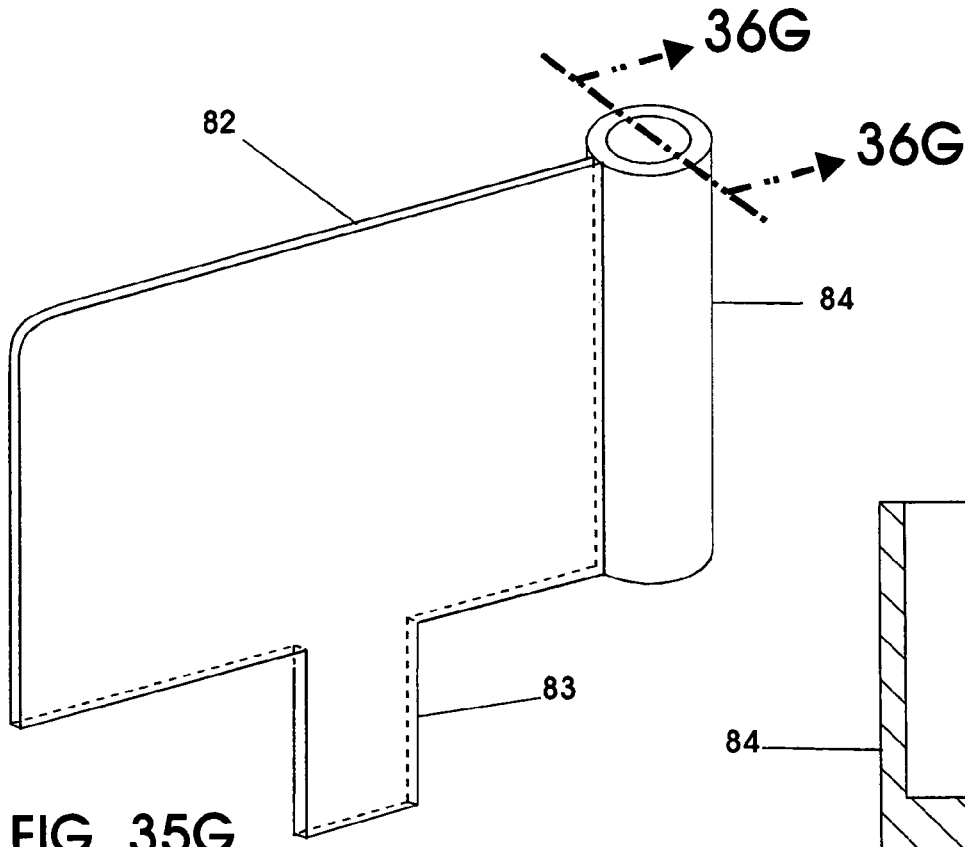

FIG. 35G is a perspective view of a protective plate with score card and pencil holder.

Figure 36G:
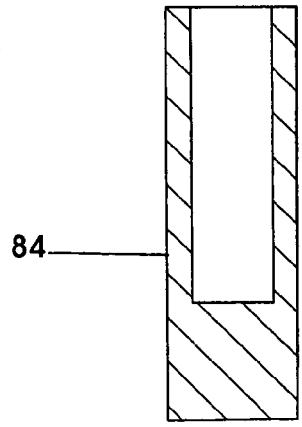

FIG. 36G is a sectional view of the pencil holder of FIG. 35G.

Figure 37G:
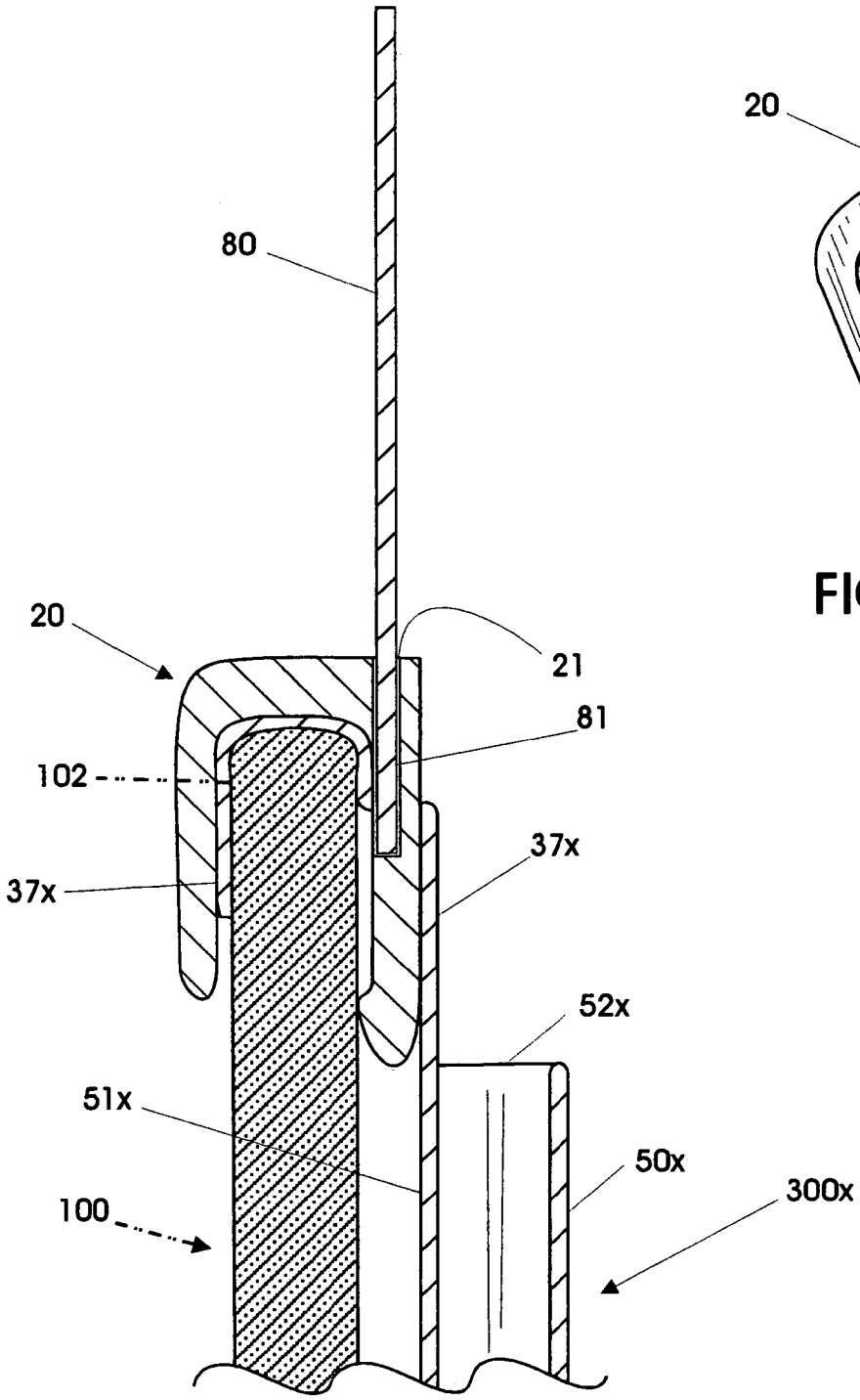

FIG. 37G is a sectional view of FIG. 32G.

Figure 38G:
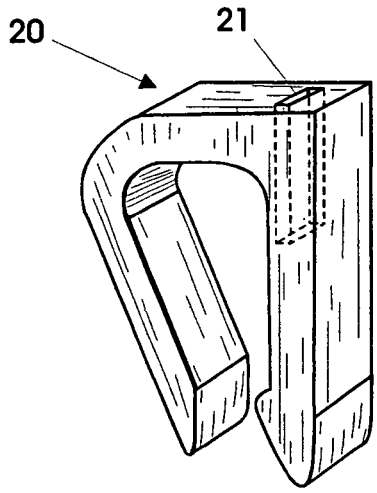

FIG. 38G is a perspective view of a hook-with-slot.

A Fifth Embodiment

Figure 1A:
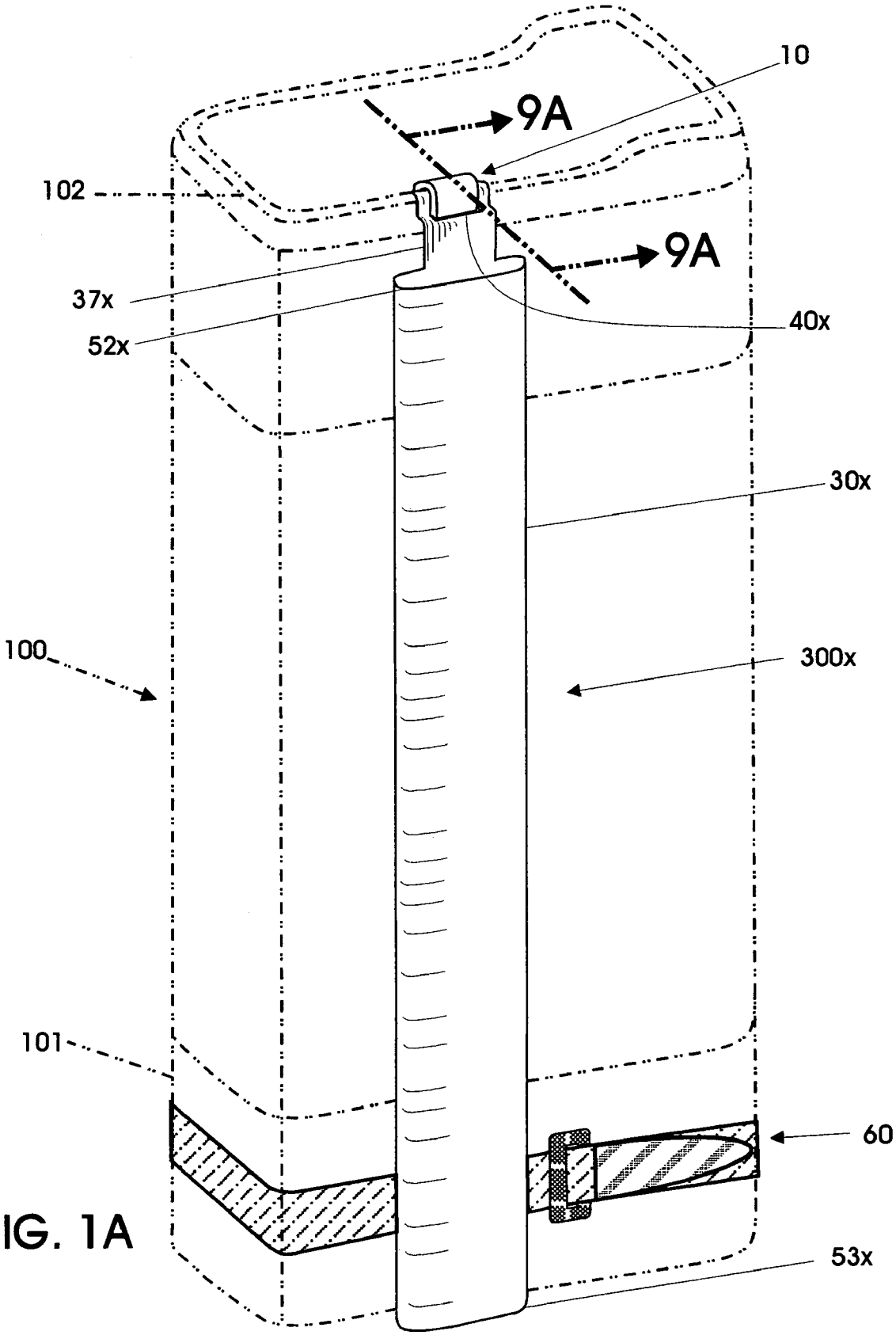
Figure 39A:
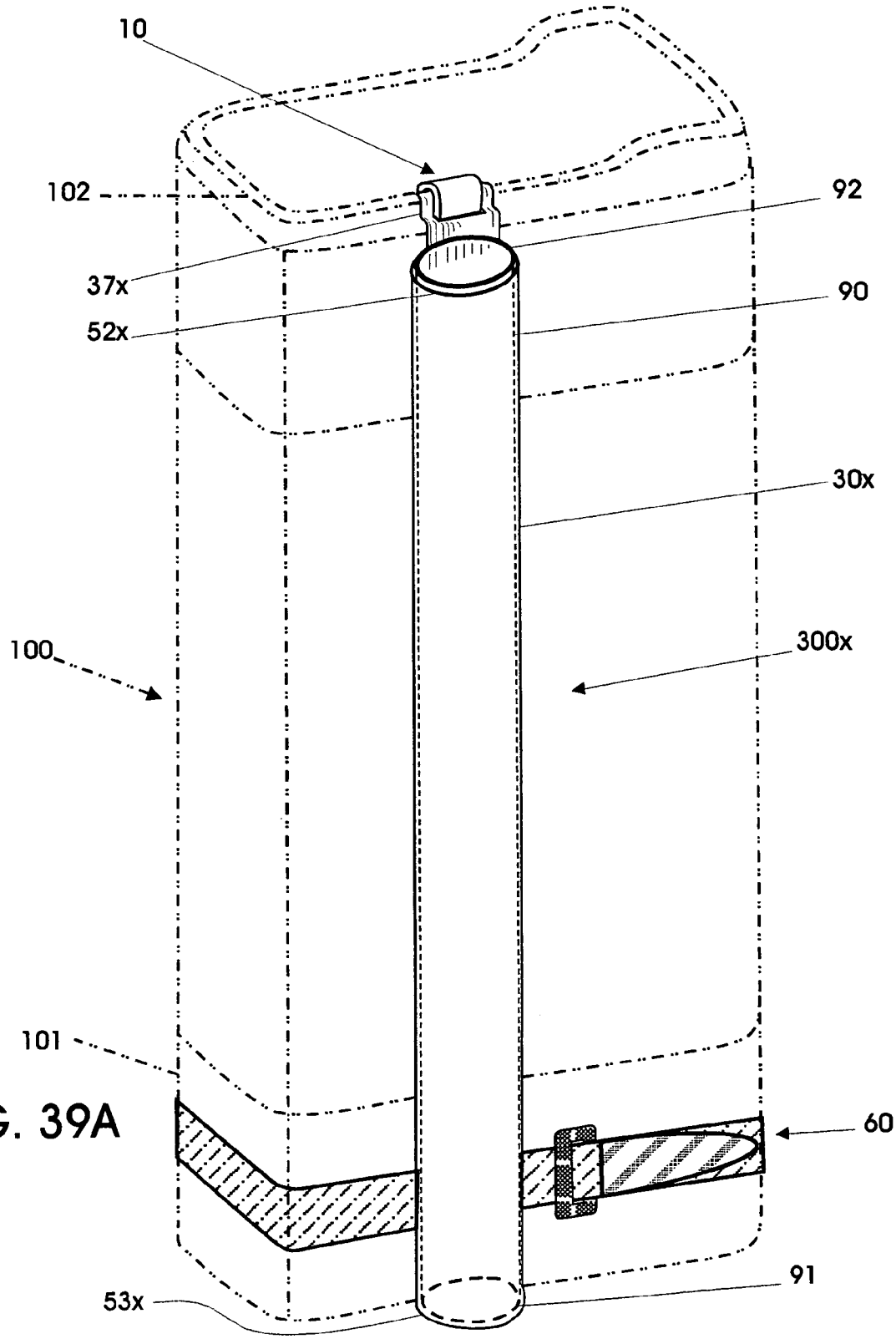

FIG. 39A is a perspective view of FIG. 1A with a tube inserted into the putter holder.

A Sixth Embodiment

Figure 40A:
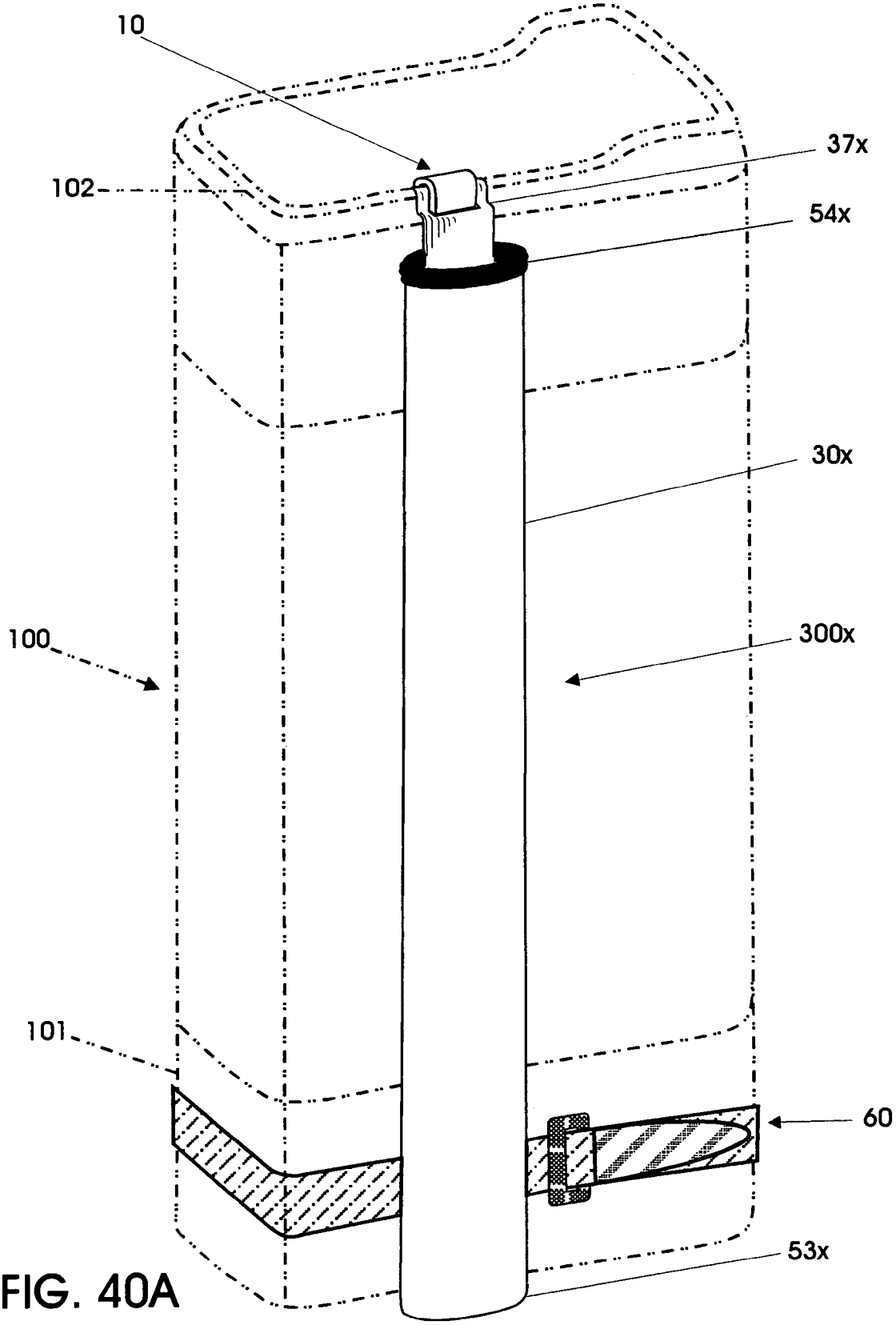

FIG. 40A is a perspective view of FIG. 1A with a collar affixed to the sleeve mouth.

LIST OF REFERENCE NUMERALS

Reference Numerals in Drawings

| | |
|---|---|
| 10 | hook |
| 20 | hook-with-slot |
| 21 | hook-slot |
| 30x | sleeve x |
| 30y | sleeve y |
| 30z | sleeve z |
| 31x | sleeve x bottom tab slit 1 |
| 31y | sleeve y bottom tab slit 1 |
| 32x | sleeve x bottom tab slit 2 |
| 32y | sleeve y bottom tab slit 2 |
| 33y | sleeve y slit 3 |
| 34y | sleeve y slit 4 |
| 35y | sleeve y bottom tab slit 5 |
| 36y | sleeve y bottom tab slit 6 |
| 37x | sleeve x top tab |
| 37y | sleeve y top tab |
| 37z | sleeve z top tab |
| 38x | sleeve x bottom tab |
| 38y | sleeve y bottom tab |
| 38z | sleeve z bottom tab |
| 39x | sleeve x slot |
| 39z | sleeve z slot |
| 40x | sleeve x top tab slot |
| 50x | sleeve x frontside |
| 50y | sleeve y frontside |
| 50z | sleeve z frontside |
| 51x | sleeve x backside |
| 51y | sleeve y backside |
| 51z | sleeve z backside |
| 52x | sleeve x mouth |
| 52y | sleeve y mouth |
| 52z | sleeve z mouth |
| 53x | sleeve x bottom |
| 53y | sleeve y bottom |
| 53z | sleeve z bottom |
| 54x | sleeve x collar |
| 60 | belt |
| 61 | belt billet |
| 62 | belt keeper |
| 63 | belt strap |
| 70 | hook & loop fastener - hook fastener A |
| 71 | hook & loop fastener - hook fastener A tape |
| 72 | hook & loop fastener - loop fastener A |
| 73 | hook & loop fastener - hook fastener B |
| 74 | hook & loop fastener - loop fastener B |
| 80 | protective plate |
| 81 | protective plate tab |
| 82 | protective plate with score card and pencil holder |
| 83 | protective plate with score card and pencil holder tab |
| 84 | pencil holder |
| 90 | tube |
| 91 | tube bottom |
| 92 | tube mouth |
| 100 | golf bag (not part of invention) |
| 101 | golf bag boot (not part of invention) |
| 102 | golf bag rim (not part of invention) |
| 200 | putter (not part of invention) |
| 300x | puffer holder x |
| 300y | putter holder y |
| 300z | putter holder z |

DETAILED DESCRIPTION

Description

Preferred Embodiment

FIG. 1*a* Through FIG. 10*d*

A preferred embodiment of the removable putter holder of the present invention is illustrated in FIG. 1A through FIG. 10D. FIG. 1A is a perspective view of putter holder x 300*x*, the preferred embodiment, attached to the upper and lower portions of a golf bag 100, by a hook 10 and a belt 60, respectively. Putter holder x 300*x* has a sleeve x 30*x* which has a sleeve x top tab 37*x*, a sleeve x mouth 52*x*, and a sleeve x bottom 53*x*. Also, as shown in FIG. 3B and FIG. 4B, sleeve x 30*x* has a sleeve x top tab 37*x*, a sleeve x top tab slot 40*x*, a sleeve x slot 39*x*, a sleeve x bottom tab 38*x*, a sleeve x bottom tab slit 1 31*x* and a sleeve x bottom tab slit 2 32*x*. The table below contains typical dimensions in centimeters for putter holder x, the preferred embodiment.

Typical dimensions for putter holder x

| Reference Number | Reference Name | Height | Width |
|---|---|---|---|
| 300x | putter holder x | 105 | 6.5/8.5 |
| 30x | sleeve x | 85 | 6.5/8.5 |
| 39x | sleeve x slot | 0.5 | 5 |
| 37x | sleeve x top tab | 8 | 5 |
| 40x | sleeve x top tab slot | 0.5 | 3 |
| 38x | sleeve x bottom tab | 12 | 5 |
| 31x | sleeve x bottom tab slit 1 | 0.5 | 3 |
| 32x | sleeve x bottom tab slit 2 | 0.5 | 3 |

Figure 2A:
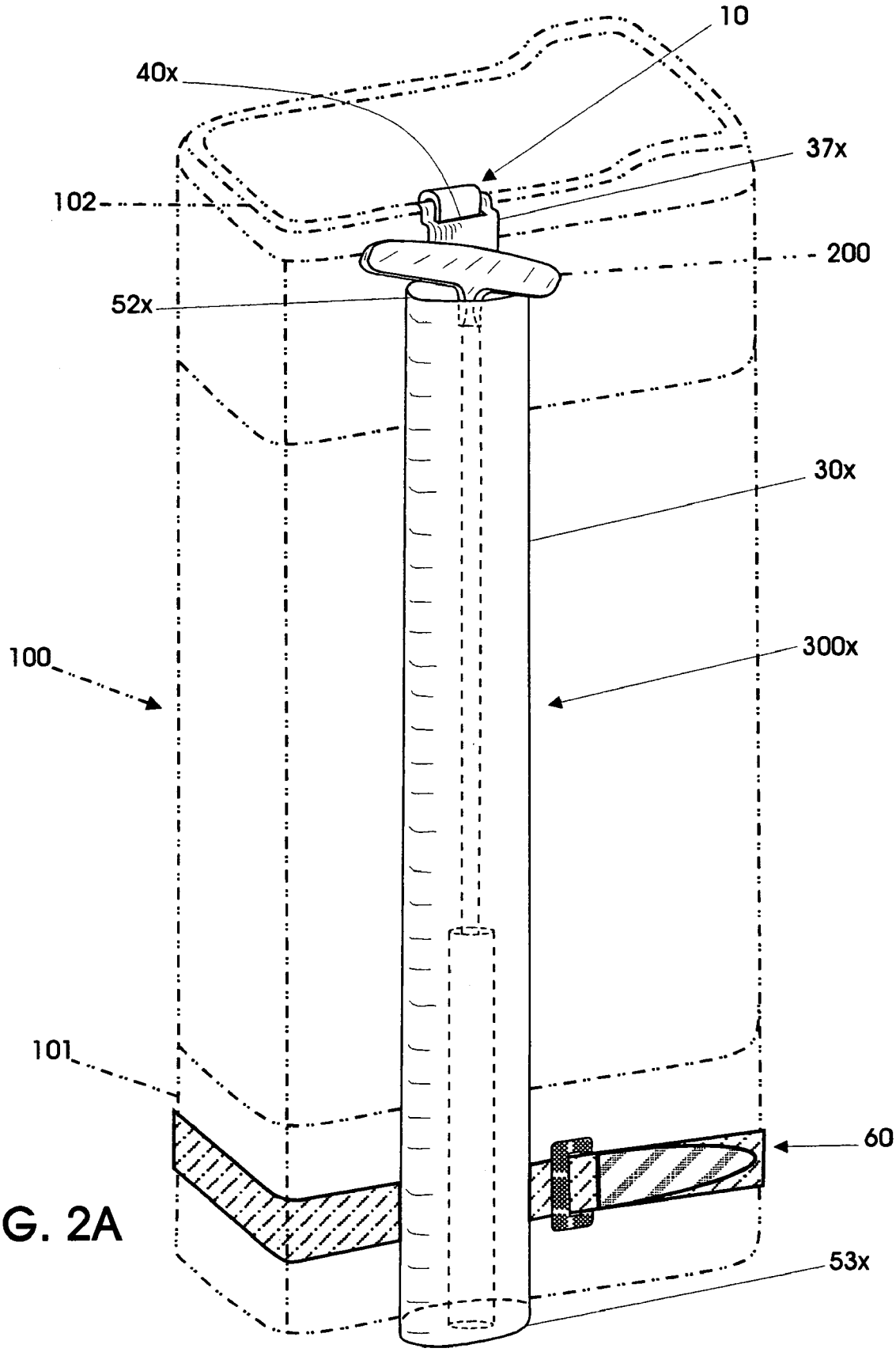
FIG. 2A shows FIG. 1A with an inverted putter inserted into the putter holder.

FIG. 2A is a perspective view of putter holder x 300*x* attached to a golf bag 100 and holding an inverted putter 200. Putter holder x 300*x* is made of a hollow, resilient, relatively flat or tubular cover, such as, the well known flexible flat discharge hose. However, putter holder x 300*x* can be made of a variety of flexible plastics, synthetic or natural fiber fabrics, or other transparent or opaque materials. Putter holder x 300*x* is typically 6.5 cm to 8.5 cm wide with an overall length of about 105 cm. Its thickness is about 0.1 cm. Its overall length includes the length of sleeve x top tab 37*x* of about 8 cm, plus the length of sleeve x bottom tab 38*x* of about 12 cm. Both sleeve x top tab 37*x* and sleeve x bottom tab 38*x* are typically 5 cm wide. Putter holder x 300*x* could have other shapes or dimensions or configurations. Other means could be used to attach it removably or permanently to a golf bag 100. It could be designed to hold more than one golf club.

Figure 3B:
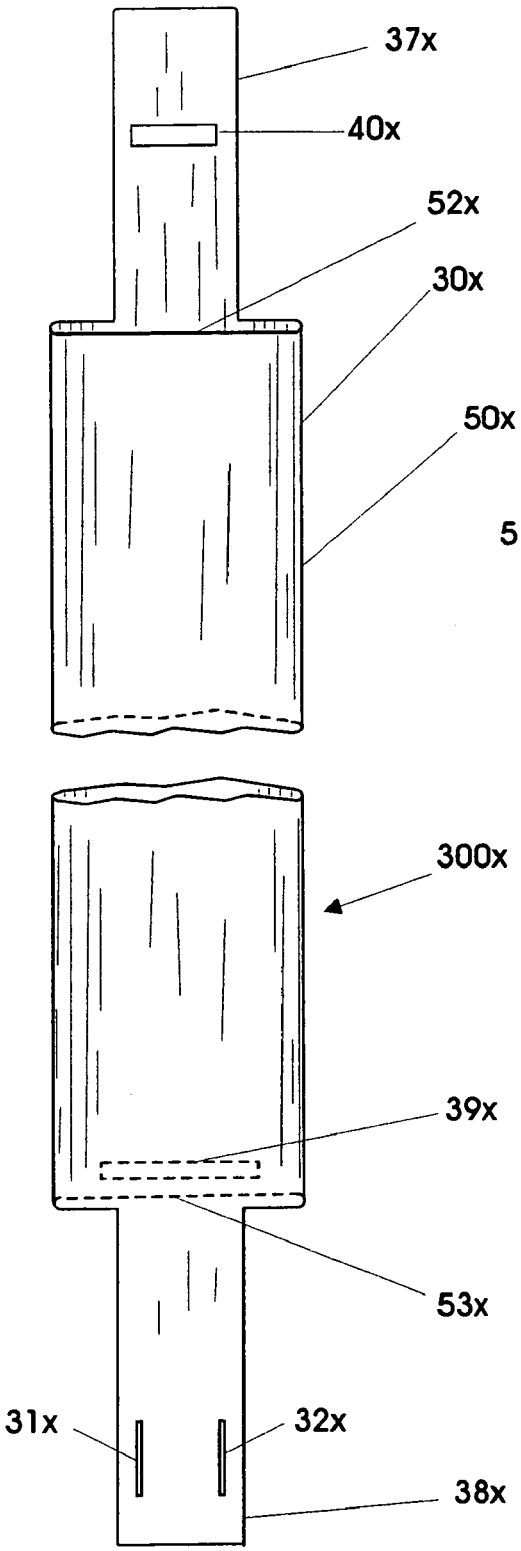
FIG. 3B shows a partial front view of a sleeve and its top and bottom tabs.
Figure 4B:
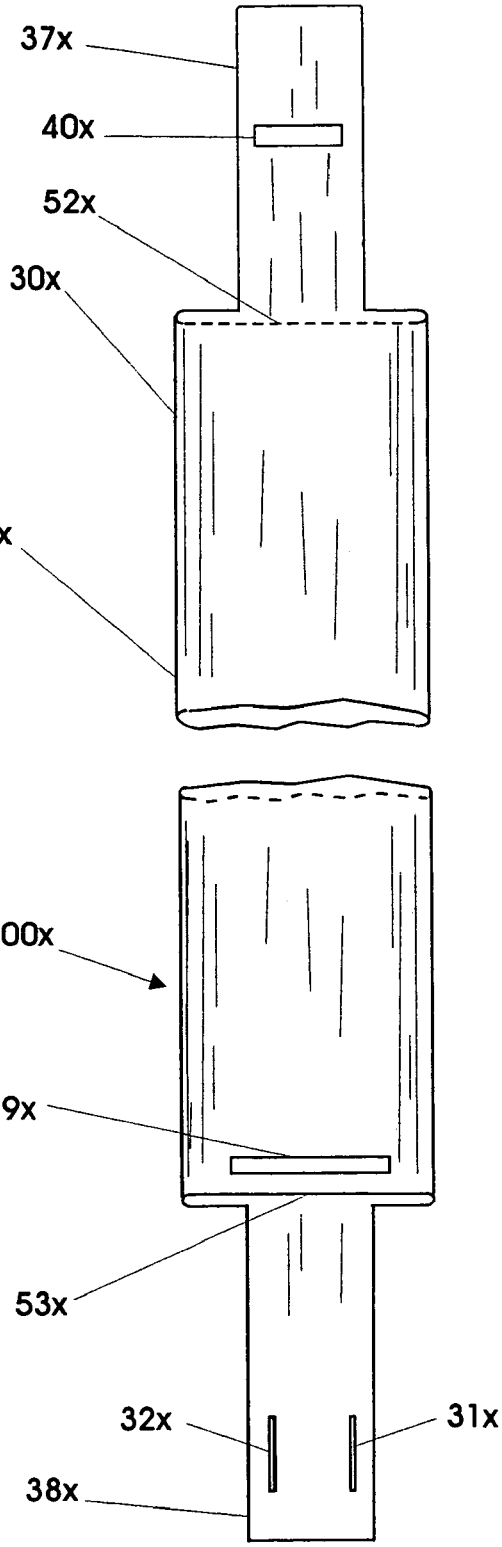
FIG. 4B shows a partial rear view of a sleeve and its top and bottom tabs.

Putter holder x 300*x* has a sleeve x 30*x*. FIG. 3B and FIG. 4B, respectively, are front and back views of sleeve x 30*x* which has a sleeve x mouth 52*x*, a sleeve x bottom 53*x*, a sleeve x top tab 37*x*, a sleeve x bottom tab 38*x* and a sleeve x slot 39*x*. Sleeve x top tab 37*x* has a sleeve x top tab slot 40*x*. Sleeve x bottom tab 38*x* has two slits, sleeve x bottom tab slit 1 31*x* and sleeve x bottom tab slit 2 32*x*. Sleeve x top tab slot 40*x* is sized to accept and accommodate the long leg of hook 10. Sleeve x slot 39*x* is sized to accept and accommodate sleeve x bottom tab 38*x*. The two slits, sleeve x bottom tab slit 1 31*x* and sleeve x bottom tab slit 2 32*x* are sized to accept and accommodate belt 60.

Figure 5B:
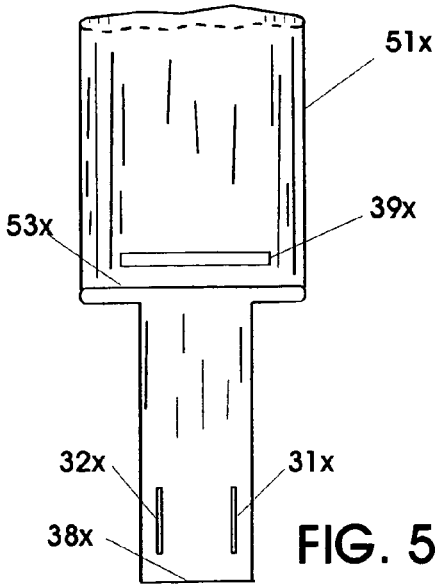
FIG. 5B shows a partial rear view of the bottom part of a sleeve, its slot and its tab with slits.

FIG. 5B is a partial view, showing sleeve x backside 51*x*. FIG. 5B is a rear view of the lower part of sleeve x 30*x* illustrating the position and orientation of sleeve x slot 39*x*, sleeve x bottom tab 38*x*, sleeve x bottom tab slit 1 31*x* and sleeve x bottom tab slit 2 32*x*.

Figure 6B:
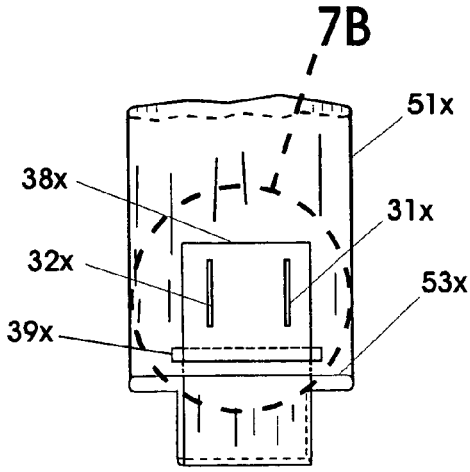
FIG. 6B shows a partial rear view of the bottom part of a sleeve with its tab threaded through its slot.

FIG. 6B is a partial view, of sleeve x backside 51*x*. FIG. 6B is a rear view of the lower part of sleeve x 30*x* illustrating sleeve x bottom tab 38*x* folded over and threaded through sleeve x slot 39*x*.

Figure 7B:
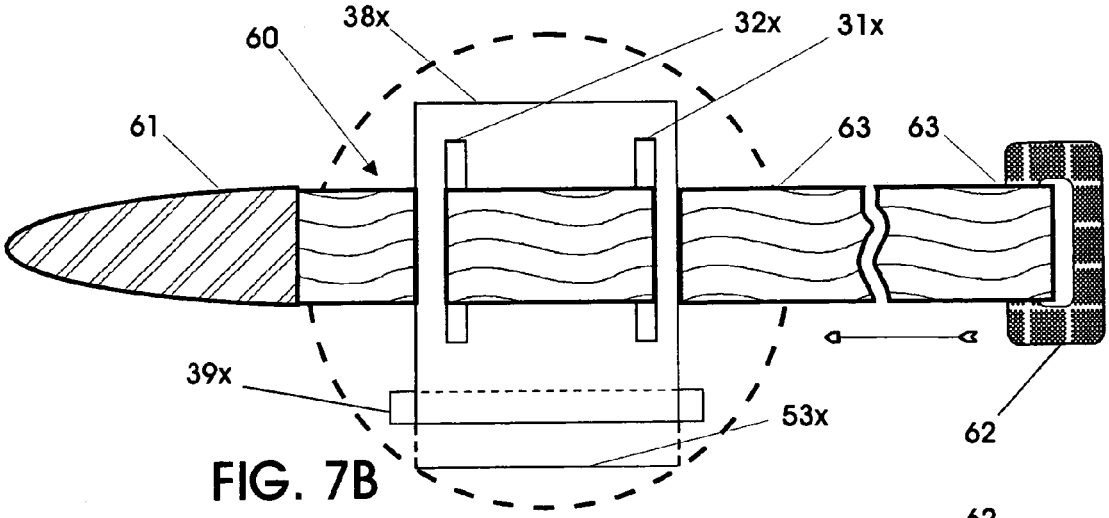
FIG. 7B shows an enlarged view of a portion of FIG. 6B with a belt threaded through the tab slits.

FIG. 7B is an enlarged view of a section of FIG. 6B showing sleeve x bottom tab 38*x* threaded through sleeve x slot 39*x*. FIG. 7B also shows a bottom view of belt 60 threaded sequentially through sleeve x bottom tab slit 1 31*x* and sleeve x bottom tab slit 2 32*x*.

FIG. 8C is a top view of belt 60, which is a hook-and-loop type fastener. FIG. 8C illustrates the parts of belt 60; the belt strap 63, belt billet 61 and belt keeper 62. The length of belt 60 exceeds the circumference of golf bag boot 102. Belt 60 is typically 77 to 85 cm in overall length, 2.5 to 3 cm wide and 0.1 to 0.2 cm thick.

Figure 9A:
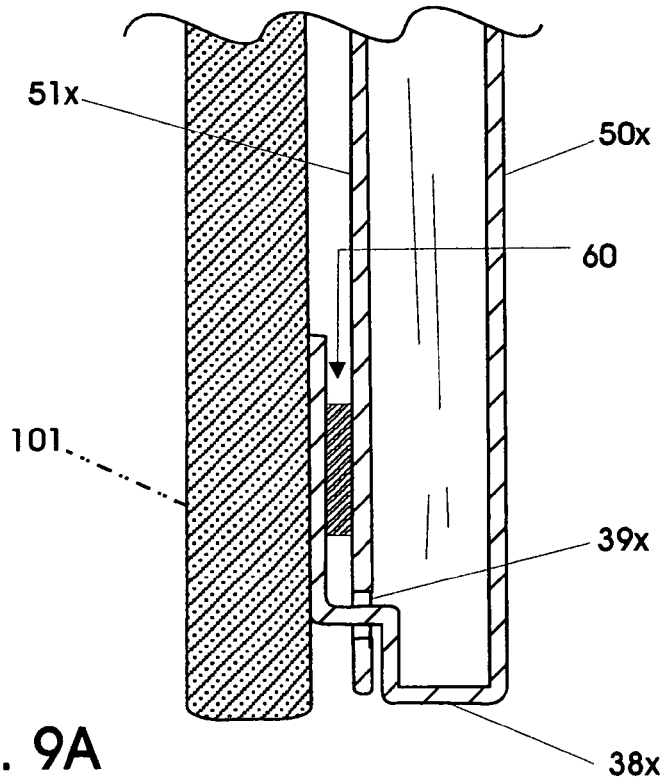
FIG. 9A shows a sectional view of FIG. 1A.

FIG. 9A is a sectional view of the putter holder of this invention attached to the upper and lower portions of a golf bag. The putter holder is attached to golf bag rim 102 by sleeve x top tab 37*x* and hook 10. The putter holder is attached to golf bag boot 101 by sleeve x bottom tab 38*x* and belt 60. The putter holder is firmly and removably attached to the upper and lower parts of the golf bag.

Figure 10D:
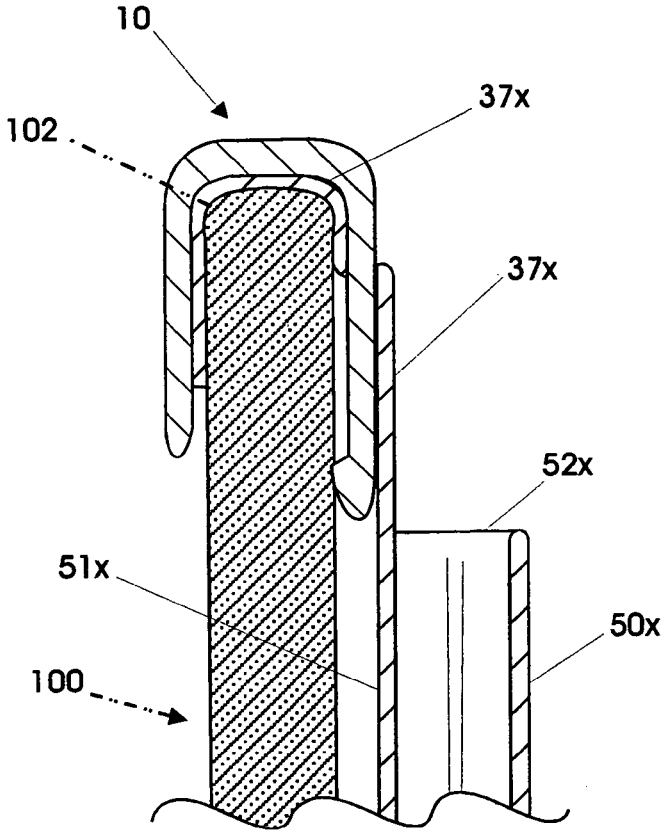
FIG. 10D shows a bifurcated hook used to fasten the top portion of a sleeve to the rim of a golf bag.
Figure 10D:
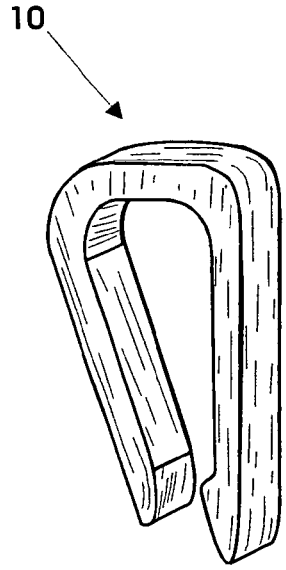

FIG. 10D is a perspective view of hook 10. Hook 10 is made of a flexible plastic, or other suitable material. Hook 10 is bifurcated. Its long front leg is about 3.8 cm in length, the other leg is about 3.2 cm. The legs are about 2.0 cm wide by about 0.4 cm inch thick. The section of hook 10 joining the two legs is about 2.0 cm long.

The upper part of FIG. 9A is a sectional view of sleeve x top tab 37*x* folded over golf bag rim 102 with hook 10 engaged to hold sleeve x top tab 37*x* in place. Hook 10 is engaged by threading its long front leg through sleeve x top tab slot 40*x* while at the same time placing the shorter leg over sleeve x top tab 37*x* and pressing hook 10 firmly into place. Thus, sleeve x top tab 37*x* and hook 10, in combination, serve to removably attach the putter holder of this invention to the upper portion of a golf bag. It should be noted that sleeve x top tab slot 40*x* is optional. Hook 10 serves to attach sleeve x top tab 37*x* to the upper portion of golf bag 100 with or without being threaded through a slot in sleeve x top tab 37*x*.

The lower part of FIG. 9A is a sectional view of sleeve x bottom tab 38*x* threaded through sleeve x slot 39*x* and attached to golf bag boot 101 by belt 60. Thus, belt 60 holds sleeve x bottom tab 38*x* snugly to golf bag boot 101. Sleeve x bottom tab 38*x* and belt 60, in combination, serve to attach putter holder x 300*x* to the lower portion of golf bag 100. Sleeve x bottom tab 38*x* also serves to dose the open sleeve x bottom 53*x* of sleeve x 30*x*, providing a stop and support for an inverted golf club or other tool inserted into putter holder x 300*x*.

In other embodiments there may be one or more slots in the sleeve or no slots at all. In other embodiments there may be one or more slots in the top tab, or no slots at all. In other embodiments there may be one or more slits in the bottom tab or no slits at all.

Operation

Preferred Embodiment

FIG. 1*a* Through FIG. 10*d*

FIG. 1A shows putter holder x 300*x* attached to golf bag 100. FIG. 2A shows it holding an inverted putter 200. Putter holder x 300*x* must first be prepared, in combination with a belt 60, to be attached to golf bag 100. To do so, thread sleeve x bottom tab 38*x* through sleeve x slot 39*x* as shown in FIG. 6B. Next, thread belt 60, in sequence, through sleeve x bottom tab slit 1 31*x* and sleeve x bottom tab slit 2 32*x* as shown in FIG. 7B. Putter holder x 300*x* is now prepared to be attached to golf bag 100.

The prepared putter holder is attached to a golf bag as follows. By choosing a location to attach the putter holder to the golf bag, and by placing the putter holder and golf bag in close proximity lengthwise, top to top and bottom to bottom, at the chosen location. Then, by engaging belt 60 and hook 10, in combination, with putter holder x 300*x* and golf bag 100.

As shown in FIG. 1A, place the bottom end of putter holder x 300*x* and the closed end of golf bag 100 in the same plane, level with each other. Wrap belt 60 around golf bag boot 101. Engage the hook-and-loop fastener of belt 60 to attach putter holder x 300*x* snugly to golf bag boot 101.

Fold sleeve x top tab 37*x* over golf bag rim 102. Place hook 10 over the folded sleeve x top tab 37*x*. Then, thread its front leg through sleeve x top tab slot 40*x*. This places the back leg of hook 10 on the inside of golf bag 100. Finally, press hook 10 into place, tightly against sleeve x top tab 37*x*. This results in hook 10 holding sleeve x top tab 37*x* snugly to golf bag rim 102 of golf bag 100. Thus, the putter holder is securely and removably attached to the exterior of a golf bag providing means for holding and protecting a golf club or other implement used in the game of golf, the golf club or other implement being rendered readily and conveniently accessible by a golfer.

The putter holder is removed from a golf bag as follows. Disengage the hook-and-loop fastener of belt 60. This releases the bottom portion of putter holder x 300*x* from attachment to golf bag boot 102. Remove hook 10 from its installed position where it is holding sleeve x top tab 37*x* firmly against golf bag rim 102. The removable putter holder is no longer attached to golf bag 100.

Description

Second Embodiment

FIG. 11A Through FIG. 21A

The removable putter holder of the second embodiment is attached to the upper portion of a golf bag, not by a hook, but, by a hook-and-loop (H&L) fastener. Dimensions of the hook-and-loop fastener are typically 4 cm wide by 9 cm long.

The second embodiment of the putter holder of the present invention is illustrated in FIG. 11A through FIG. 21A. FIG. 11A is a perspective view of putter holder y 300*y* attached to the upper and lower portions of golf bag 100 by a hook-and-loop fastener and a belt 60, respectively. Putter holder y 300*y* has a sleeve y 30*y* which has a sleeve y top tab 37*y*, a sleeve y mouth 52*y*, and a sleeve y bottom 53*y*. Also shown in FIG. 15B and FIG. 16B, respectively, are front and back views of sleeve y 30*y* which has a sleeve y mouth 52*y*, a sleeve y bottom 53*y*, a sleeve y top tab 37*y*, a sleeve y bottom tab 38*y* and two slits, sleeve y slit 3 33*y* and sleeve y slit 4 34*y*. The sleeve y bottom tab 38*y* has four slits: sleeve y bottom tab slit 1 31*y*; sleeve y bottom tab slit 2 32*y*; sleeve y bottom tab slit 5 35*y*; and sleeve y bottom tab slit 6 36*y*. The backside of sleeve y top tab 37*y* has loop fastener A 72 attached with adhesive. The table below contains typical dimensions in centimeters for puffer holder y, the second embodiment.

Typical dimensions for putter holder y.

| Reference Number | Reference Name | Height | Width |
|---|---|---|---|
| 300y | putter holder y | 105 | 6.5/8.5 |
| 30y | sleeve y | 85 | 6.5/8.5 |
| 33y | sleeve y slit 3 | 0.5 | 3 |
| 34y | sleeve y slit 4 | 0.5 | 3 |
| 37y | sleeve y top tab | 8 | 5 |
| 38y | sleeve y bottom tab | 12 | 5 |
| 31y | sleeve y bottom tab slit 1 | 0.5 | 3 |
| 32y | sleeve y bottom tab slit 2 | 0.5 | 3 |
| 35y | sleeve y bottom tab slit 5 | 0.5 | 3 |
| 36y | sleeve y bottom tab slit 6 | 0.5 | 3 |

FIG. 12A is a perspective view of putter holder y 300*y* attached to golf bag 100 and holding an inverted putter. In both the preferred and second embodiment the putter holder is made of a hollow, resilient, relatively flat or tubular cover, such as, the well known flexible flat discharge hose. However, the putter holder can be made of a variety of flexible plastics, synthetic or natural fiber fabrics, or other opaque or transparent materials. Putter holder y 300*y* is typically 6.5 cm to 8.5 cm wide with an overall length of about 105 cm. Its thickness is about 0.1 cm. Its overall length includes the length of the sleeve y top tab 37*y* of about 8 cm, plus the length of the sleeve y bottom tab 38*y* of about 12 cm. Putter holder y 300*y* could have other shapes, other dimensions, other configurations. Other means could be used to attach it either removably or permanently to a golf bag. It could be designed to hold more than one golf club or other implement.

FIG. 13E illustrates removal of hook fastener A tape 71 and the adhesive side of hook fastener A 70 being attached to the inside of the upper portion of golf bag 100. FIG. 14E illustrates the final position of hook fastener A 70 attached to the upper portion of golf bag 100. In this position, hook fastener A 70 is ready to engage loop fastener A 72 which is attached by adhesive to the backside of sleeve y top tab 37*y*. Thus, providing attachment of the putter holder to the upper portion of golf bag 100 by means of a hook-and-loop fastener.

FIG. 17B is a rear view of the lower part of sleeve y 30*y* illustrating the position and orientation of sleeve y bottom tab slit 1 31*y*, sleeve y bottom tab slit 2 32*y*, sleeve y slit 3 33*y*, sleeve y slit 4 34*y*, sleeve y bottom tab slit 5 35*y*, and sleeve y bottom tab slit 6 36*y*.

FIG. 18B is a rear view of the lower part of sleeve y 30*y* illustrating sleeve y bottom tab 38*y* folded over sleeve y 30*y*. FIG. 18B also shows the two central sleeve y bottom tab slits, sleeve y bottom tab slit 2 32*y* and sleeve y bottom tab slit 5 35*y*, placed over and aligned with the two sleeve y slits, sleeve y slit 3 33*y* and sleeve y slit 4 34*y*.

FIG. 19B is an enlarged view of a section of FIG. 18B. It shows the backside of belt 60 threaded sequentially through sleeve y bottom tab slit 1 31*y*, sleeve y bottom tab slit 2 32*y*, sleeve y slit 3 33*y*, sleeve y slit 4 34*y*, sleeve y bottom tab slit 5 35*y* and lastly, sleeve y bottom tab slit 6 36*y*. Thus belt 60 serves to join sleeve y 30*y* and sleeve y bottom tab 38*y* into a single unit which is attached by belt 60 to the lower portion of golf bag 100. Sleeve y bottom tab 38*y* also serves to close the open sleeve y bottom 53*y* of sleeve y 30*y*, providing a stop and support for an inverted golf club or other tool inserted into the putter holder.

FIG. 20C is a top view of belt 60, which is a H&L type fastener. FIG. 20C illustrates the parts of belt 60; belt strap 63, belt billet 61 and belt keeper 62. The length of belt 60 exceeds the circumference of golf bag boot 101 of golf bag 100. Belt 60 is typically 77 to 85 cm in overall length, 2.5 to 3 cm wide and 0.1 to 0.2 cm thick.

FIG. 21A is a sectional view of the removable putter holder attached to the upper portion of a golf bag by a H&L fastener and to the lower portion by a belt. FIG. 21A illustrates the parts of putter holder y 300*y*. They are sleeve y 30*y*, sleeve y top tab 37*y*, sleeve y bottom tab 38*y*, sleeve y frontside 50*y*, sleeve y backside 51*y*, sleeve y mouth 52*y*, sleeve y bottom 53*y*, and loop fastener A 72. Loop fastener A 72 is attached by adhesive to the backside of sleeve y top tab 37*y*. FIG. 21A also shows golf bag rim 102 with hook fastener A 70 attached by adhesive.

The upper part of FIG. 21A is a sectional view of sleeve y top tab 37*y* folded over golf bag rim 102 with the H&L fastener engaged to hold sleeve y top tab 37*y* in place. Sleeve y top tab 37*y* is pressed firmly into place holding sleeve y top tab 37*y* snugly to golf bag rim 102.

The lower part of FIG. 21A is a sectional view of sleeve y bottom tab 38*y* and sleeve y backside 51*y* attached to golf bag boot 101 by strap 63 of belt 60.

Operation

Second Embodiment

FIG. 11A Through FIG. 21A

FIG. 11A shows putter holder y 300*y* attached to golf bag 100. FIG. 12A shows it holding an inverted putter 200. Both the putter holder and the golf bag must be prepared for attachment before the putter holder can be attached to the golf bag. First choose a location to attach the putter holder external to the golf bag. At the chosen location, attach hook fastener A 70 to golf bag rim 102 as shown in FIG. 13E and FIG. 14E. Next, attach loop fastener A 72 to the backside of sleeve y top tab 37*y* as shown in FIG. 15B and FIG. 16B. Next, attach belt 60 to the sleeve y bottom tab 38*y* and sleeve y 30*y* as shown in FIG. 18B and FIG. 19B. To do so, fold sleeve y bottom tab over the backside of sleeve y 30*y* as shown in FIG. 18B. Then, thread belt 60, in sequence, through sleeve y bottom tab slit 1 31*y*, sleeve y bottom tab slit 2 32*y*, sleeve y slit 3 33*y*, sleeve y slit 4 34*y*, sleeve y bottom tab slit 5 35*y*, sleeve y bottom tab slit 6 36*y* as shown in FIG. 19B.

Putter holder y 300*y* is now prepared to be attached to golf bag 100. The prepared putter holder is attached to a golf bag as follows. First, by placing the putter holder and golf bag in close proximity lengthwise, top to top and bottom to bottom, at the chosen location. Next, as shown in FIG. 11A, place the bottom end of putter holder y 300*y* and the closed end of golf bag 100 in the same plane, level with each other. Wrap belt 60 around golf bag boot 101. Engage the hook-and-loop fastener of belt 60 to attach the lower portion of putter holder y 300*y* snugly to golf bag boot 101.

Fold sleeve y top tab 37*y* over golf bag rim 102 and engage the hook-and-loop fastener to hold the top portion of putter holder y 300 *y* to golf bag rim 102 of golf bag 100. The hook-and-loop fastener is engaged by pressing sleeve y top tab 37*y*, and therefore, loop fastener A 72, down into place, tightly against hook fastener A 70. This results in sleeve y top tab 37*y* being attached snugly to golf bag rim 102 of golf bag 100.

Thus, putter holder y 300*y* is securely and removably attached to the exterior of a golf bag providing means for holding and protecting a golf club or other implement used in the game of golf, the golf club or other implement being rendered readily and conveniently accessible by a golfer.

The putter holder is removed from a golf bag as follows. To release the bottom portion of putter holder y 300*y*, from attachment to golf bag boot 102, disengage the hook-and-loop fastener of belt 60. To release the upper portion of putter holder y 300*y* from attachment to golf bag rim 102, disengage sleeve y top tab 37*y* from its attachment via hook-and-loop fastener to golf bag rim 102. The removable putter holder is no longer attached to the golf bag.

Description

Third Embodiment

FIG. 22A Through FIG. 30A

A third embodiment of the removable putter holder of the present invention is illustrated in FIG. 22A through FIG. 30A. The putter holder of this embodiment is attached to the upper and lower portions of a golf bag by hook-and-loop (H&L) fasteners. Dimensions of the hook-and-loop fasteners are typically 4 cm wide by 9 cm long. FIG. 22A is a perspective view of putter holder z 300*z* attached to a golf bag 100. FIG. 22A illustrates several parts of putter holder z 300*z*. They are sleeve z 30*z*, sleeve z mouth 52*z*, sleeve z bottom 53*z* and sleeve z top tab 37*z*. FIG. 22A also shows golf bag 100, golf bag rim 102 and golf bag boot 101. FIG. 23A is a perspective view of the putter holder attached to a golf bag and holding an inverted putter. The table below contains typical dimensions in centimeters for putter holder z, a third embodiment.

Typical dimensions for putter holder z.

| Reference Number | Reference Name | Height | Width |
|---|---|---|---|
| 300z | putter holder z | 105 | 6.5/8.5 |
| 30z | sleeve z | 85 | 6.5/8.5 |
| 39z | sleeve z slot | 0.5 | 5 |
| 37z | sleeve z top tab | 8 | 5 |
| 38z | sleeve z bottom tab | 12 | 5 |

The putter holder is typically 6.5 cm to 8.5 cm wide with an overall length of about 105 cm. Its thickness is about 0.1 cm. Its overall length includes the length of sleevez top tab 37*z* of about 8 cm, plus the length of sleevez bottom tab of about 12 cm. The putter holder could have other shapes, other dimensions, other configurations. Other means could be used to attach the puffer holder permanently to a golf bag. It could be designed to hold more than one golf club or other implement.

Putter holder z 300*z* of this embodiment is attached to the upper and lower portions of a golf bag by H&L fasteners. FIG. 24F illustrates the hook material of a H&L fastener attached to the upper and lower portions of a golf bag with adhesive. The H&L fastener attached to the upper portion of the golf bag is rectangular and typically is 6 to 10 cm in length by 4 to 6 cm in width. The H&L fastener attached to the lower portion of the golf bag is also rectangular and typically is 6 to 10 cm in length by 4 to 6 cm in width. The two fasteners are in-line with one another as illustrated in FIG. 24F. In this position, the hook material is ready to engage two corresponding parts of H&L fastener loop material attached to the top and bottom tabs of sleeve z 30*z*, thereby, providing a removable attachment of putter holder z 300*z* to golf bag 100.

The removable putter holder z 300*z* has a sleeve z 30*z* FIG. 25B and FIG. 26B, respectively, are front and back views of sleeve z 30*z* which has a sleeve z mouth 52*z*, a sleeve z bottom 53*z*, a sleeve z top tab 37*z*, a sleeve z bottom tab 38*z* and a sleeve z slot 39*z*. FIG. 25B shows the frontside of sleeve z bottom tab 38*z* with loop material 74 of a H&L fastener attached with adhesive. FIG. 26B shows the backside of sleeve z top tab 37*z* with loop material 72 of a H&L fastener attached with adhesive.

FIG. 27B is a rear view of the lower part of putter holder z 300*z* illustrating the position and orientation of the sleeve z slot 39*z* and loop material 74 of a H&L fastener attached to the backside of sleeve z bottom tab 38*z* with adhesive.

FIG. 28B is a rear view of the lower part of putter holder z 300*z* illustrating the sleeve z bottom tab 38*z* folded over and threaded through the sleeve z slot 39*z* FIG. 28B also shows loop material 74 of a H&L fastener attached to the sleeve z bottom tab 38*z* with adhesive.

FIG. 29B is an enlarged view of a section of FIG. 28B illustrating the sleeve z bottom tab 38*z* folded over and threaded through the sleeve z slot 39*z*.

FIG. 30A is a sectional view of putter holder z 300*z* attached to golf bag 100. The putter holder is attached to the upper and lower portions of the golf bag by H&L fasteners. FIG. 30A illustrates the parts of putter holder z 300*z*. They are sleeve z 30*z*, sleeve z top tab 37*z*, sleeve z bottom tab 38*z*, sleeve z frontside 50*z*, sleeve z backside 51*z*, sleeve z mouth 52*z*, and sleeve z bottom 53*z* Loop fastener A 72 is shown attached by adhesive to the backside of sleeve z top tab 37*z* FIG. 30A also shows golf bag rim 102 with hook fastener A 70 attached by adhesive.

The upper part of FIG. 30A is a sectional view of sleeve z top tab 37*z* folded over golf bag rim 102 with a H&L fastener engaged to hold sleeve z top tab 37*z* in place. Also shown is hook material 70 attached to golf bag rim 102 by adhesive and loop material 72 attached to the backside of sleeve z top tab 37*z* by adhesive. Sleeve z top tab 37*z* is pressed firmly into place holding sleeve z top tab 37*z* snugly to golf bag rim 102.

The lower part of FIG. 30A is a sectional view of the sleeve z bottom tab 38*z* threaded through the sleeve z slot 39*z* and attached to golf bag boot 101 by a H&L fastener, thereby holding sleeve z bottom tab 38*z* in place. Also shown is hook material 73 attached to golf bag boot 101 by adhesive and loop material 74 attached to the frontside of sleeve z bottom tab 38*z* by adhesive. Sleeve z bottom tab 38*z* is pressed firmly into place holding the putter holder snugly to golf bag boot 101.

Operation

Third Embodiment

FIG. 22A Through FIG. 30A

FIG. 22A shows putter holder z 300*z* attached to golf bag 100. FIG. 23A shows it holding an inverted putter 200. Both the putter holder and the golf bag must be prepared for attachment before the putter holder can be attached to the golf bag. First choose a location to attach the putter holder externally to the golf bag. At the chosen location, attach hook fastener A 70 to golf bag rim 102 and attach hook fastener A 73 to golf bag boot 101 as shown in FIG. 24F. Next, attach loop fastener A 72 to the backside of sleeve z top tab 37*z* and attach loop fastener A 74 to the frontside of sleeve z bottom tab 38*z* as shown in FIG. 25B and FIG. 26B. Next, thread sleeve z bottom tab 38*z* through sleeve z slot 39*z* as shown in FIG. 28B and FIG. 29B. Putter holder z 300*z* is now prepared to be attached to golf bag 100.

The prepared putter holder is attached to a golf bag as follows. First, by placing the putter holder and golf bag in close proximity lengthwise, top to top and bottom to bottom, at the chosen location. Next, as shown in FIG. 22A, place the bottom end of putter holder z 300*z* and the closed end of golf bag 100 in the same plane, level with each other. Engage loop fastener A 74 of sleeve z bottom tab 38*z* with hook fastener A 73 of golf bag boot 102. This holds the lower portion of putter holder z 300*z* to golf bag boot 101 of golf bag 100.

Next fold sleeve z top tab 37*z* over golf bag rim 102. Engage loop fastener A 72 of sleeve z top tab 37*z* with hook fastener A 70 of golf bag rim 102. This holds the upper portion of putter holder z 300*z* to golf bag rim 102 of golf bag 100. The hook-and-loop fastener is engaged by pressing sleeve z top tab 37*z*, and therefore, loop fastener A 72, down into place, tightly against hook fastener A 70. This results in sleeve z top tab 37*z* being attached snugly to golf bag rim 102 of golf bag 100.

Thus, putter holder z 300*z* is securely and removably attached to the exterior of a golf bag providing means for holding and protecting a golf club or other implement used in the game of golf, the golf club or other implement being rendered readily and conveniently accessible by a golfer.

The putter holder is removed from a golf bag as follows. To release the lower portion of putter holder z 300*z*, from attachment to golf bag boot 101, remove sleeve z bottom tab 38*z* from its attachment via hook-and-loop fastener to golf bag boot 101. To release the upper portion of putter holder z 300*z* from attachment to golf bag rim 102, remove sleeve z top tab 37*z* from its attachment via hook-and-loop fastener to golf bag rim 102. The removable putter holder is no longer attached to the golf bag.

Description

Fourth Embodiment

FIG. 31G Through FIG. 38G

A fourth embodiment of the removable putter holder of the present invention is illustrated in FIG. 31G through FIG. 38G. Both the preferred and the fourth embodiments use putter holder x 300*x*. The table below contains typical dimensions in centimeters for putter holder x 300*x*.

Typical dimensions for putter holder x.

| Reference Number | Reference Name | Height | Width |
|---|---|---|---|
| 300x | putter holder x | 105 | 6.5/8.5 |
| 30x | sleeve x | 85 | 6.5/8.5 |
| 39x | sleeve x slot | 0.5 | 5 |
| 37x | sleeve x top tab | 8 | 5 |
| 40x | sleeve x top tab slot | 0.5 | 3 |
| 38x | sleeve x bottom tab | 12 | 5 |
| 31x | sleeve x bottom tab slit 1 | 0.5 | 3 |
| 32x | sleeve x bottom tab slit 2 | 0.5 | 3 |

FIG. 31G is a perspective view of the fourth embodiment with a putter inserted into the putter holder. There are two differences between the preferred and the fourth embodiment. First, the preferred embodiment has a hook 10, while the fourth embodiment has a hook-with-slot 20 which is illustrated in FIG. 38G. Hook-with-slot 20 has a hook-slot 21. Second, the fourth embodiment introduces a protective plate 80 with protective plate tab 81, shown in FIG. 34G. The fourth embodiment also introduces a protective plate with scorecard and pencil holder 82 with a protective plate with scorecard and pencil holder tab 83, shown in FIG. 35G. Pencil holder 84 is shown in FIG. 35G and FIG. 36G. The two embodiments are the same in other respects, in that, putter holder x 300*x* is attached to the lower portion of golf bag 100 by belt 60.

The fourth embodiment introduces a hook-with-slot 20 and two different protective plates, protective plate 80 and protective plate 82. There are variations with regard to combining either of the protective plates with hook-with-slot 20. In this embodiment the combination of hook and plate is optional. That is, the hook may be used with or without one of the protective plates. Another variation is to combine a hook and a plate into a single unit rather than two separate units. FIG. 34G is a perspective view of protective plate 80 and its tab 81. The dimensions of protective plate 80 are typically 18 cm wide by 9 cm high. Protective plate tab 81 is typically 3 to 4 cm high by 2 to 3 cm wide. Both protective plate 80 and its tab are typically 0.3 to 0.4 thick FIG. 35G is a perspective view of the protective plate with scorecard and pencil holder 82 and its tab 83. This protective plate has two distinct sides, a front side and a back side. They are, spaced apart, separated by about 0.1 cm. Each side is about 18 cm wide by 9 cm high. Protective plate with scorecard and pencil holder tab 83 is typically 3 to 4 cm high by 2 to 3 cm wide. Both protective plate with scorecard and pencil holder 82 and its tab are typically 0.3 to 0.4 thick FIG. 36G is a sectional view of pencil holder 84. It is about 9 cm high overall with an outer diameter of about 1.4 cm. Its inner diameter is about 1.0 cm with a depth of about 5 to 6 cm.

FIG. 32G is a perspective view illustrating the position and orientation of hook-with-slot 20 and its relation to sleeve x 30*x*. Also shown is protective plate 80 with its tab inserted into hook-slot 21 of hook-with-slot 20. FIG. 33G is a perspective view illustrating the position and orientation of hook-with-slot 20 and its relation to sleeve x 30*x*. Also shown is protective plate with scorecard and pencil holder 82 with its tab is inserted into hook-slot 21 of hook-with-slot 20.

FIG. 37G is a sectional view illustrating putter holder x 300*x* attached to golf bag rim 102 of golf bag 100. The putter holder is attached to the upper portion of golf bag 100 by sleeve x top tab 37*x* and hook-with-slot 20. FIG. 37G is a sectional view of sleeve x top tab 37*x* folded over golf bag rim 102 of golf bag 100 and hook-with-slot 20 engaged to hold sleeve x top tab 37*x* in place. The two legs of the bifurcated hook-with-slot 20 are placed over sleeve x top tab 37*x*. The front leg is threaded through the slot in sleeve x top tab 37*x*. Hook-with-slot 20 is pressed firmly into place holding sleeve x top tab 37*x* snugly to golf bag rim 102 of golf bag 100. Protective plate tab 81 is inserted into hook-slot 21.

FIG. 38G is a perspective view of hook-with-slot 20 which is made of a flexible plastic or other suitable material. Hook-with-slot 20 is bifurcated. The front leg is about 7 cm long, the other about 6 cm long. The legs are about 4 cm wide and about 0.5 to 0.6 cm thick. The section joining the two legs is about 2 to 2.5 cm long. Hook-slot 21 is typically 4 cm high by 3 cm wide by 0.4 to 0.5 cm thick. Hook-slot 21 receives and retains either protective plate tab 81 or the protective plate with scorecard and pencil holder tab 83. Hook-with-slot 20 combined with either of the two protective plates serves to protect and separate putters of above average length from contact with other golf clubs carried in a golf bag.

Operation

Fourth Embodiment

FIG. 31G Through FIG. 38G

FIG. 31G shows puffer holder x 300*x* attached to golf bag 100, holding an inverted putter 200, with protective plate 80 attached by hook-with-slot 20. FIG. 32G illustrates protective plate 80 with its tab inserted into hook-slot 21 of hook-with-slot 20. FIG. 33G illustrates protective plate with score card and pencil holder 82 with its tab inserted into hook-slot 21 of hook-with-slot 20. Before either protective plate can be installed, putter holder x 300*x* must be attached to golf bag 100. To attach putter holder x 300*x* to golf bag 100, follow the instructions found in the "Operation" section of the "Preferred Embodiment", and by substituting "hook-with-slot 20" for "hook 10". These instructions result in the putter holder being attached to the golf bag by a belt and hook-with-slot 20.

Hook-with-slot 20 can receive and retain either protective plate. To install protective plate 80, insert its protective plate tab 81 into hook-slot 21 of hook-with-slot 20. To install protective plate with scorecard and pencil holder 82, insert its protective plate with scorecard and pencil holder tab 83 into hook-slot 21 of hook-with-slot 20. Protective plate with scorecard and pencil holder is ready to hold a scorecard and pencil.

Either protective plate is removed by lifting the plate from its installed position in hook-slot 21 of hook-with-slot 20. The putter holder is removed from a golf bag as follows. Disengage the hook-and-loop fastener of belt 60. This releases the bottom portion of putter holder x 300*x* from attachment to golf bag boot 102. Remove hook-with-slot 20 from its installed position where it is holding sleeve x top tab 37*x* firmly against golf bag rim 102. The removable putter holder is no longer attached to golf bag 100.

Description

Fifth Embodiment

FIG. 39A

A fifth embodiment of the removable putter holder of the present invention is illustrated in FIG. 39A. The putter holder of the preferred embodiment is used in the fifth embodiment. It is the same as putter holder x 300*x* of the preferred embodiment but with the addition of tube 90. The only difference between the preferred and the fifth embodiment is the addition of tube 90 in the fifth embodiment. Putter holder x 300*x* has a sleeve x 30*x* with sleeve x mouth 52*x*. Tube 90 is inserted into sleeve x 30*x* and constitutes the fifth embodiment. The table below contains typical dimensions in centimeters for putter holder x 300*x*.

Typical dimensions for putter holder x.

| Reference Number | Reference Name | Height | Width |
|---|---|---|---|
| 300x | putter holder x | 105 | 6.5/8.5 |
| 30x | sleeve x | 85 | 6.5/8.5 |
| 39x | sleeve x slot | 0.5 | 5 |
| 37x | sleeve x top tab | 8 | 5 |
| 40x | sleeve x top tab slot | 0.5 | 3 |
| 38x | sleeve x bottom tab | 12 | 5 |
| 31x | sleeve x bottom tab slit 1 | 0.5 | 3 |
| 32x | sleeve x bottom tab slit 2 | 0.5 | 3 |

FIG. 39A is a perspective view of putter holder x 300*x* attached to a golf bag with tube 90 inserted. Tube 90 is well known as a lipped plastic cylindrical tube. Wilson, the sporting goods company, makes such a tube. It is known as the Wilson Jumbo Golf Club Tube (W323J). Dennco, Inc of Salem, N.H. also makes such a tube. A typical tube 90 size is approximately 86.4 cm in length, 3.3 to 3.5 cm in outer diameter and 0.08 to 0.16 cm in thickness.

Operation

Fifth Embodiment

FIG. 39A

FIG. 39A shows putter holder x 300*x* attached to golf bag 100 with tube 90 inserted into sleeve x 30*x*. A putter or other implement can be inserted into tube 90. To attach putter holder x 300*x* to golf bag 100, see the instructions found in the "Operation" section of the "PreferredEmbodiment". Tube 90 is installed as follows. Tube bottom 91 is inserted into sleeve x mouth 52*x*. Then tube 90 is pressed into sleeve x 30*x* for its full length, until tube bottom 91 is even with sleeve x bottom 53*x*. Tube 90 is now ready to accept a putter or other implement. Tube 90 is removed simply by extracting it from sleeve x 30*x*.

Description

Sixth Embodiment

FIG. 40A

A sixth embodiment of the removable putter holder of the present invention is illustrated in FIG. 40A. The putter holder of the preferred embodiment is used in the sixth embodiment. It is the same as the putter holder of the preferred embodiment but with the addition of a sleeve x collar 54*x* attached to the mouth of sleeve x 30*x*. Hook 10 and belt 60 of the preferred embodiment are also used in the sixth embodiment. The difference between the preferred and the sixth embodiment is the addition of sleeve x collar 54*x* in the sixth embodiment. Putter holder x 300*x* has a sleeve x 30*x* with a sleeve x mouth 52*x*. Sleeve x collar 54*x* is attached to sleeve x mouth 52*x* constituting a sixth embodiment. FIG. 40A is a perspective view of putter holder x 300*x* attached to golf bag 100 with sleeve x collar 54*x* attached to the mouth of sleeve x 30*x*. Sleeve x collar 54*x* attaches to sleeve x 30*x* from one edge of the sleeve x top tab 37*x* to the other. Sleeve x collar 54*x* is made of a flexible plastic, or other suitable material. Sleeve x collar 54*x* is a segment of a bifurcated band approximately 7 to 8 cm long. Sleeve x collar 54*x* has two legs of about 1.5 to 2 cm in length and about 0.1 to 0.2 cm in thickness. The two legs are separated by approximately 0.08 to 0.12 cm. The two legs are placed over the mouth of sleeve x 30*x* and pressed into place, thus stiffening the opening of putter holder x 300*x* into which an inverted putter or other tool can be inserted. The table below contains typical dimensions in centimeters for putter holder x 300*x*.

Typical dimensions for putter holder x.

| Reference Number | Reference Name | Height | Width |
|---|---|---|---|
| 300x | putter holder x | 105 | 6.5/8.5 |
| 30x | sleeve x | 85 | 6.5/8.5 |
| 39x | sleeve x slot | 0.5 | 5 |
| 37x | sleeve x top tab | 8 | 5 |
| 40x | sleeve x top tab slot | 0.5 | 3 |
| 38x | sleeve x bottom tab | 12 | 5 |
| 31x | sleeve x bottom tab slit 1 | 0.5 | 3 |
| 32x | sleeve x bottom tab slit 2 | 0.5 | 3 |

Operation

Sixth Embodiment

FIG. 40A

FIG. 40A shows putter holder x 300*x* attached to golf bag 100 with sleeve x collar 54*x* installed. A putter or other implement can be inserted into sleeve x 30*x*. To attach putter holder x 300*x* to golf bag 100, follow the instructions found in the "Operation" section of the "PreferredEmbodiment".

Sleeve x collar 54*x* is attached to sleeve x 30*x* from one edge of sleeve x top tab 37*x* to the other. Attach sleeve x collar 54*x* to the mouth of sleeve x 30*x* as follows. Sleeve x collar 54*x* is a circular segment of a bifurcated band with two legs. Press the two legs over sleeve x mouth 52*x* of sleeve x 30*x* and press the collar into place. An inverted putter or other tool can be inserted through the collar and into sleeve x 30*x*. Collar 54*x* is removed simply by extracting the collar from the mouth of sleevex 30*x*.

CONCLUSION, RAMIFICATIONS, SCOPE

My Putter Pal Putter Holder is a novel, attractive, unique, practical, easy to use device for holding and protecting a golf club or other implement during a round of golf. This device is comprised of three parts. First a sleeve, second a hook and third a belt. The three parts, in combination with a golf bag, provide a golfer with an easily accessible holder for carrying, storing and retrieving a golf putter during a round of golf. The sleeve is hollow and serves as a putter holder. The sleeve has a top tab and a bottom tab. The hook, in combination with the top tab, is used to attach the top part of the sleeve to the rim of a golf bag. The belt, in combination with the bottom tab, is used to attach the bottom part of the sleeve to the boot of a golf bag. The bottom tab also serves to close the open bottom of the sleeve. Thus, my putter holder is removably attached to a chosen exterior surface of a golf bag, and a golfer may insert an inverted putter or other golf club or implement into the putter holder.

My putter holder has many desirable features and benefits which are clearly presented in the drawings and detailed description. My putter holder has many improvements and advantages over prior art. While, at the same time, exhibiting few, if any, of the disadvantages of prior art.

My putter holder is simple, unique and attractive. It makes improvements over prior art. It meets or exceeds objectives for protecting a putter. It make locating, accessing and storing a putter quick and easy and saves time in doing so. My putter holder will cost less to manufacture than much of the prior art. Use of my putter holder will save time for golfers playing a round of golf. My putter holder has a surface area large enough for display of advertisements, logos, art, designs, print and other visual aids.

The above descriptions contain many specific features. However, they should not be construed as limiting the scope of this invention, but as providing illustrations of a finite number of presently preferred embodiments. For example, the putter holder can be made from a variety of flexible plastics, synthetic or natural fibers, or other transparent or opaque materials. My putter holder could have other shapes, dimensions or configurations. Other means could be used to attach the holder either removably or permanently to a golf bag.

I claim:

1. In a golf club carrying system having a removable device for attaching to the exterior of a golf bag, for holding a golf club or other implement, said device comprising:

(a) holding means for holding the golf club or other implement, and (b) fastening means for fastening said holding means externally to the golf bag, whereby, said device is securely and removably attached to the exterior of a golf bag providing means for holding and protecting a golf club or other implement used during a round in the game of golf, the golf club or other implement being rendered readily and conveniently accessible by a golfer;

(c) said holding means comprising:

(d) a hollow, open ended, flat or tubular sleeve, and (e) wherein said sleeve is of predetermined inner diameter, length, width and shape, and (f) wherein said sleeve is made of flexible plastic or natural or synthetic fabric, and (g) said sleeve further including front and back sides, top and bottom ends, top and bottom tabs and a slot, and (h) wherein said top tab extends from said top end of said back side of said sleeve and is of predetermined length and width, and (i) wherein said top tab has a slot of predetermined length, width, location and orientation, and (j) wherein said bottom tab extends from said bottom end of said front side of said sleeve and is of predetermined length and width, and (k) wherein said bottom tab has a plurality of slits of predetermined length, width, location and orientation, and (l) wherein said bottom tab serves to close said bottom end of said sleeve, and (m) wherein said slot in said sleeve is located near said bottom end of said back side of said sleeve and is of predetermined length, width, location and orientation.

* * * * *